US009772571B2

(12) United States Patent
Matsushima et al.

(10) Patent No.: US 9,772,571 B2
(45) Date of Patent: Sep. 26, 2017

(54) ELECTROSTATIC IMAGE DEVELOPING TONER AND METHOD FOR PRODUCING THE SAME

(71) Applicant: Konica Minolta, Inc., Tokyo (JP)

(72) Inventors: Kaori Matsushima, Hino (JP); Tomoko Mine, Hino (JP); Tomomi Oshiba, Hachioji (JP)

(73) Assignee: KONICA MINOLTA, INC., Tokyo (JP)

( * ) Notice: Subject to any disclaimer, the term of this patent is extended or adjusted under 35 U.S.C. 154(b) by 0 days.

(21) Appl. No.: 15/182,825

(22) Filed: Jun. 15, 2016

(65) Prior Publication Data

US 2017/0010551 A1 Jan. 12, 2017

(30) Foreign Application Priority Data

Jul. 9, 2015 (JP) ..... 2015-138102

(51) Int. Cl.
*G03G 9/08* (2006.01)
*G03G 9/087* (2006.01)

(52) U.S. Cl.
CPC ..... *G03G 9/08755* (2013.01); *G03G 9/0804* (2013.01); *G03G 9/0821* (2013.01); *G03G 9/08711* (2013.01); *G03G 9/08786* (2013.01); *G03G 9/08795* (2013.01); *G03G 9/08797* (2013.01)

(58) Field of Classification Search
CPC ..... G03G 9/08755; G03G 9/08711; G03G 9/08786; G03G 9/0821
USPC ..... 430/109.4
See application file for complete search history.

(56) References Cited

U.S. PATENT DOCUMENTS

2006/0204880 A1* 9/2006 Mizutani ..... G03G 9/0806 430/109.4
2015/0153670 A1 6/2015 Shimano et al.

FOREIGN PATENT DOCUMENTS

| | | | |
|---|---|---|---|
| JP | 2004-264498 | A | 9/2004 |
| JP | 2006251564 | A | 9/2006 |
| JP | 2008-107769 | A | 5/2008 |
| JP | 2011-197659 | A | 10/2011 |
| JP | 2013-025258 | A | 2/2013 |
| JP | 2014-235394 | A | 12/2014 |

OTHER PUBLICATIONS

Notice of Reasons for Rejection dated Jun. 27, 2017 from corresponding Japanese Patent Application No. JP 2015-138102 and English translation.

* cited by examiner

*Primary Examiner* — Mark A Chapman
(74) *Attorney, Agent, or Firm* — Lucas & Mercanti, LLP

(57) ABSTRACT

An electrostatic image developing toner includes: a binder resin containing a crystalline polyester resin and an amorphous resin, wherein when, in differential scanning calorimetry of the toner according to ASTM D3418-8, a temperature of an endothermic peak derived from the crystalline polyester resin in a first heating process is defined as Tm1 (° C.), an endothermic quantity based on the endothermic peak in the first heating process is defined as ΔH1 (J/g), an endothermic quantity based on the endothermic peak in a second heating process is defined as ΔH2 (J/g), and a softening temperature is defined as $T_{f1/2}$ (° C.), Tm1 is 60 to 80° C., $T_{f1/2}$ is 95 to 125° C., and ΔH1 and ΔH2 satisfy the relationship represented by the following Formula (1) and (2):

[Math. 1]

$$0.65 \leq \Delta H2/\Delta H1 \leq 0.95 \quad (1)$$

$$205-(1.4\times Tm1) < T_{f1/2} \leq 220-(1.4\times Tm1) \quad (2).$$

15 Claims, No Drawings

ELECTROSTATIC IMAGE DEVELOPING TONER AND METHOD FOR PRODUCING THE SAME

The entire disclosure of Japanese Patent Application No. 2015-138102 filed on Jul. 9, 2015 including description, claims, drawings, and abstract are incorporated herein by reference in its entirety.

BACKGROUND OF THE INVENTION

Field of the Invention

The present invention relates to an electrostatic image developing toner and a method for producing the electrostatic image developing toner.

Description of the Related Art

In recent years, for the purpose of increasing a printing speed, reducing environmental load, and the like, there is a demand for a decrease in thermal energy at the time of fixing a toner image.

As such, in order to decrease thermal energy at the time of fixing a toner image, a technique capable of improving low-temperature fixability of toner is demanded. As a means for achieving such an object, a method of utilizing a crystalline resin, such as crystalline polyester, having excellent sharp melt property as a binder resin is mentioned.

For example, JP 2006-251564 A proposes an electrostatic image developing toner including a binder resin which contains a crystalline polyester resin and an amorphous resin. In this way, by using the crystalline polyester resin and the amorphous resin in combination, when a temperature in the temperature history at the time of fixing exceeds the melting point of the crystalline polyester resin, a crystalline portion is melted and the crystalline polyester resin and the amorphous resin are compatibilized with each other. Thus, low temperature fixation can be achieved. Further, in JP 2006-251564 A, by setting the thermal properties of the crystalline polyester resin and the amorphous resin contained in the binder resin within a specific range, fixation can be achieved at a lower temperature as compared with the related art.

According to the technique disclosed in JP 2006-251564 A described above, it is possible to obtain a toner having satisfactory low temperature fixability. However, in recent years, printed articles are increasingly diversified, and there is a demand for achieving not only low temperature fixability but also a balance between other properties and low temperature fixability.

For example, when a thin sheet with a small basis weight (mass per 1 $m^2$) is used, hot offset becomes problematic in some cases. When hot offset occurs, a problem arises in that a supporting body is easily wound on a fixing roller and an image cannot be stably obtained. Further, with the diversity of printed articles, there is also an increasing demand for a technique capable of suppressing the gloss of an image. Further, a case where glossiness of a printed image is easily changed depending on a fixing temperature (that is, fixing temperature dependency of glossiness) is also problematic. In a case where the fixing temperature dependency of glossiness is great, handleability deteriorates in terms of suppression of gloss. For this reason, there is a tendency that a technique capable of reducing the fixing temperature dependency of glossiness is also demanded.

As described above, in the technique of forming an image using the toner, there is a demand for not only improving low temperature fixability but also improving various properties, such as hot offset resistance and an effect of suppressing gloss of an image, with a good balance. However, the technique disclosed in JP 2006-251564 A does not satisfy all properties described above with a good balance.

SUMMARY OF THE INVENTION

In this regard, an object of the present invention is to provide a means for having an excellent low-temperature fixing effect and for improving both of hot offset resistance and an effect of suppressing gloss of an image in an electrostatic image developing toner. In addition, another object of the present invention is to provide a means capable of reducing fixing temperature dependency of glossiness in an electrostatic image developing toner.

The present inventors conducted intensive studies. As a result of these intensive studies, they found that, when thermal properties are set within a specific range by using a binder resin containing a crystalline polyester resin and an amorphous resin, the problem described above can be solved. Thus, the present invention has been completed.

To achieve at least one of the abovementioned objects, according to an aspect, an electrostatic image developing toner reflecting one aspect of the present invention comprises: a binder resin containing a crystalline polyester resin and an amorphous resin, wherein when, in differential scanning calorimetry of the toner according to ASTM DD3418-8, a temperature of an endothermic peak derived from the crystalline polyester resin in a first heating process is defined as Tm1 (° C.), an endothermic quantity based on the endothermic peak in the first heating process is defined as ΔH1 (J/g), an endothermic quantity based on the endothermic peak in a second heating process is defined as ΔH2 (J/g), and a softening temperature is defined as $T_{f1/2}$ (° C.), Tm1 is 60 to 80° C., $T_{f1/2}$ is 95 to 125° C., and ΔH1 and ΔH2 satisfy the relationship represented by the following Formulae (1) and (2):

[Math. 1]

$$0.65 \leq \Delta H2/\Delta H1 \leq 0.95 \quad (1)$$

$$205-(1.4\times Tm1) < T_{f1/2} \leq 220-(1.4\times Tm1) \quad (2)$$

DESCRIPTION OF THE PREFERRED EMBODIMENTS

Hereinafter, an embodiment of the present invention will be described. However, the scope of the invention is not limited to the illustrated examples. Further, in the present specification, the expression "X to Y" representing a range indicates "equal to or higher than X but equal to or lower than Y." Furthermore, unless otherwise specified, an operation. and measurement for physical properties or the like are performed under the conditions of room temperature (20 to 25° C)/relative humidity of 40 to 50%.

According to an embodiment of the present invention, there is provided an electrostatic image developing toner including: a binder resin containing a crystalline polyester resin and an amorphous resin, in which when, in differential scanning calorimetry of the toner according to ASTM D3418-8, a temperature of an endothermic peak derived from the crystalline polyester resin in a first heating process is defined as Tm1 (° C.), an endothermic quantity based on the endothermic peak in the first heating process is defined as ΔH1 (J/g), an endothermic quantity based on the endothermic peak in a second heating process is defined as ΔH2 (J/g), and a softening temperature is defined as $T_{f1/2}$ (° C.), Tm1 is 60 to 80° C., $T_{f1/2}$ is 95 to 125° C., and ΔH1 and ΔH2 satisfy the relationship represented by the above Formulae (1) and (2)."

Incidentally, in the present specification, the term "electrostatic image developing toner" may be simply referred to as the "toner."

Regarding the toner according to the present invention, as described above, a binder resin that constitutes the toner contains a crystalline polyester resin and an amorphous resin, and the toner has specific thermal properties.

As described above, the crystalline polyester resin is effective for improvement in the low temperature fixability of the toner. More specifically, by using the crystalline polyester resin and the amorphous resin in combination, when a temperature exceeds the melting point of the crystalline polyester resin, a crystalline portion is melted and the melted crystalline portion is compatibilized with the amorphous resin so that low temperature fixation can be performed.

Further, the toner of the present invention satisfies the above Formula (1). Herein, in the above Formula (1), a large value of ΔH2/ΔH1 represents that compatibility between the crystalline polyester resin and the amorphous resin at the time of heat fixing is suppressed. On the other hand, a small value thereof represents that the crystalline polyester resin and the amorphous resin are easily compatibilized with each other. Therefore, as represented in the above Formula (1), when the value of ΔH2/ΔH1 is 0.65 to 0.95, it can be said that compatibility between the crystalline polyester resin and the amorphous resin is appropriately controlled. In particular, when the value of ΔH2/ΔH1 is more than 0.95, the crystalline polyester resin and the amorphous resin are not easily compatibilized, and thus it is difficult to obtain fixability at a low temperature. However, as in the present invention, the value is set to 0.95 or less, which contributes to the low temperature fixability of the toner.

Furthermore, in the toner of the present invention, the melting point of the crystalline polyester resin constituting the binder resin is within the range of 60 to 80° C. The toner of the present invention satisfying such a condition can be sufficiently softened at the time of heat fixing, and contributes to further improvement in low temperature fixability.

In addition, as described above, in recent years, as printed articles tend to be diversified, a technique capable of forming an image with excellent hot offset resistance and low glossiness (no glossy feeling) is demanded in some cases.

In regard to such a demand, according to the present invention, when the relationship represented by the above Formula (2) is satisfied, a toner with excellent hot offset resistance can be obtained. The hot offset indicates a phenomenon that in a heat roller fixing method, some of the toner is transferred to a roller or the like so that the toner layer is broken, and this phenomenon is considered to occur due to too low viscosity when the toner is melted (softened). Therefore, as represented in the above Formula (2), when the softening temperature $T_{f1/2}$ is set in a certain range in the relationship with Tm1 (60 to 80° C.) and $T_{f1/2}$ is set to the range of 95 to 125° C., plasticization of the amorphous resin can be suppressed, and as a result, the viscosity of the toner can be properly controlled and hot offset resistance can be improved. In particular, when $T_{f1/2}$ is too low, the toner is plasticized and thus hot offset easily occurs. However, when the lower limit of $T_{f1/2}$ is set to a value as represented in the above Formula (2), proper hardness can be provided to the toner and thus this contributes to improvement in hot offset resistance.

On the other hand, when $T_{f1/2}$ is too high, low temperature fixability tends to decrease. However, when $T_{f1/2}$ is set to the upper limit of the above Formula (2), both of hot offset resistance and low temperature fixability can be achieved.

Further, as represented in the above Formula (1), when the value of ΔH2/ΔH1 is set to 0.65 or more, compatibility between the crystalline polyester and the amorphous resin is appropriately suppressed. Thus, it is possible to suppress excessive softening of the toner. Accordingly, since a decrease in viscosity of the toner caused by heating at the time of fixing as described above is suppressed, hot offset resistance can be improved.

Furthermore, the present inventors surprisingly found that the toner of the present invention can form an image with low glossiness when the relationship represented by the above Formula (2) is satisfied. In Formula (2) when the softening temperature $T_{f1/2}$ becomes about 205−(1.4×Tm1), the softening temperature of the toner is low and low temperature fixability is exerted. However, as $T_{f1/2}$ becomes lower, the suppression of gloss is difficult. In this regard, when the lower limit of $T_{f1/2}$ is set as represented in Formula (2), gloss can be suppressed in practical while low temperature fixability is maintained. The reason for this is speculated that when the value of $T_{f1/2}$ is set to be larger than the predetermined value described above, complete melting of the toner is suppressed at the time of heat fixing and some of the toner remains in a state of toner particles so that irregularities are generated on the surface of the image. In addition, since there is no case where the toner is excessively plasticized, hot offset can also be suppressed. On the other hand, when $T_{f1/2}$ is too low, since the toner is completely melted at the time of heat fixing and thus becomes flat, the surface of the image becomes smooth. Thus, it is considered that the image which is glossy is formed. In addition, hot offset easily occurs.

Further, in Formula (2) when the softening temperature $T_{f1/2}$ becomes about 220−(1.4×Tm1), the softening temperature is high, and the effect of suppressing gloss and the effect of suppressing hot offset are sufficiently exerted. However, the balance between these effects and low temperature fixability is difficult to achieve. In this regard, when the upper limit of $T_{f1/2}$ is set as represented in Formula (2), low temperature fixability is performed in practical while the effect of suppressing gloss is maintained. On the other hand, when the value of $T_{f1/2}$ is too high, practical low temperature fixability is difficult to achieve.

As described above, the toner of the present invention is effective for forming an image with low glossiness; moreover, the toner of the present invention is also excellent in terms that the fixing temperature dependency of glossiness is low. In general, in the binder resin containing a crystalline polyester resin and an amorphous resin for the purpose of improvement in low temperature fixability or the like, plasticization progresses and glossiness in a high temperature region tends to excessively increase. On the other hand, since the softening temperature $T_{f1/2}$ of the toner of present invention is within the range represented by the above Formula (2), plasticization of the binder resin does not excessively progress even in a high temperature region. Therefore, it is possible to obtain a toner which has low glossiness and in which temperature dependency of glossiness is small.

Incidentally, the above-described mechanism is based on conjecture and the present invention is not limited to the above-described mechanism.

Hereinafter, the present invention will be described.

The electrostatic image developing toner (toner) according to the present invention includes, as an essential component, a binder resin containing a crystalline polyester resin and an amorphous resin to be described below in detail. Further, the toner of the present invention satisfies the relationship represented by the following Formulae (1) to (4).

[Math. 2]

$$0.65 \leq \Delta H2/\Delta H1 \leq 0.95 \quad (1)$$

$$205-(1.4\times Tm1) < T_{f1/2} \leq 220-(1.4\times Tm1) \quad (2)$$

$$60 \leq Tm1 \leq 80 \quad (3)$$

$$95 \leq T_{f1/2} \leq 125 \quad (4)$$

At this time, definitions in Formulae (1) to (4) are as follows:

Tm1 (° C.): a temperature of an endothermic peak derived from the crystalline polyester resin in a first heating process in differential scanning calorimetry (DSC) of the toner according to ASTM D3418-8;

ΔH1 (J/g): an endothermic quantity based on the endothermic peak described above;

ΔH2 (J/g): an endothermic quantity based on the endothermic peak derived from the crystalline polyester resin in a second heating process in differential scanning calorimetry (DSC) of the toner according to ASTM D3418-8; and $T_{f1/2}$ (° C.): a softening temperature of the toner.

Incidentally, definitions relating to Tm1, $T_{f1/2}$, ΔH1, and ΔH2 described above are as described above. More specifically, values measured by methods described in the following Examples are employed.

The value of ΔH2/ΔH1 represented in the above Formula (1) is 0.65 to 0.95. The toner satisfying such a relationship is in a state where the compatibility between the crystalline polyester resin and the amorphous resin contained in the binder resin is appropriately controlled, and is excellent in low temperature fixability. On the other hand, when ΔH2/ΔH1 is less than 0.65, softening of the toner according to the compatibility of the resin excessively progresses, and thus there is concern that hot offset resistance of the toner may be lowered. However, by setting ΔH2/ΔH1 to 0.65 or more, hot offset resistance of the toner becomes favorable.

The value of ΔH2/ΔH1 is preferably 0.70 to 0.90, more preferably 0.75 to 0.85, and particularly preferably 0.75 to 0.83 from the viewpoint of improving hot offset resistance of the toner and keeping low temperature fixability favorable. The value of ΔH2/ΔH1 depends on, for example, an equivalent ratio between a hydroxyl group of a polyvalent alcohol component and a carboxyl group of a polyvalent carboxylic acid component that constitute the crystalline polyester resin. In addition, the value of ΔH2/ΔH1 is easily controlled by using a hybrid resin to be described below in detail as the crystalline polyester resin. Accordingly, when preferred embodiments to be described below are employed therefor, the value of ΔH2/ΔH1 can be controlled.

The value of Tm1 represented in the above Formulae (2) and (3) is derived from the melting point of the crystalline polyester resin, and the value thereof in the toner according to the present invention is 60 to 80° C. When Tm1 is lower than 60° C., there is concern that the toner may be plasticized and hot offset resistance thereof may be lowered. On the other hand, when Tm1 is higher than 80° C., sufficient low temperature fixability cannot be obtained. In this way, Tm1 also contributes to low temperature fixability of the toner and relates to hot offset resistance. Since low temperature fixability and hot offset resistance are in a tradeoff relationship, in consideration of the balance therebetween, Tm1 is preferably 60 to 75° C. and more preferably 65 to 75° C. The value of Tm1 also depends on, for example, an equivalent ratio between a hydroxyl group of a polyvalent alcohol component and a carboxyl group of a polyvalent carboxylic acid component that constitute the crystalline polyester resin. In addition, the value of Tm1 is easily controlled by using a hybrid resin to be described below in detail as the crystalline polyester resin. Accordingly, when preferred embodiments to be described below are employed therefor, the value of Tm1 can be controlled.

The value of $T_{f1/2}$ represented in the above Formulae (2) and (4) is a softening temperature of the toner, and the value thereof in the toner according to the present invention is 95 to 125° C. When $T_{f1/2}$ is lower than 95° C., since the toner becomes soft and is in a flat state at the time of heat fixing, the surface of the image becomes smooth. Thus, there is concern that glossiness may be increased. On the other hand, when $T_{f1/2}$ is higher than 125° C., low temperature fixability is lowered. In this way, $T_{f1/2}$ also contributes to low temperature fixability of the toner and relates to hot offset resistance. In consideration of the balance therebetween, $T_{f1/2}$ is preferably 100 to 123° C. and more preferably 110 to 120° C. $T_{f1/2}$ described above depends on the weight average molecular weight and chemical structure of the amorphous resin to be described below in detail and the weight average molecular weight of the resin included in the eluted content F(90-100) to be described below in detail. Accordingly, when preferred embodiments to be described below are employed therefor, the value of $T_{f1/2}$ can be controlled.

Further, as represented in the above Formula (2), Tm1 described above relates to the range of a value of the softening temperature $T_{f1/2}$ of the toner. That is, $T_{f1/2}$ is defined by the relationship between $T_{f1/2}$ and Tm1. As described above, in addition to defining of the numerical ranges of Tm1 and $T_{f1/2}$, when the relationship between Tm1 and $T_{f1/2}$ is further defined as represented in the above Formula (2), it is possible to not only obtain excellent hot offset resistance while maintaining excellent low temperature fixability but also to control gloss of an image.

Further, since the toner according to the present invention satisfies the thermal properties described above, the weight average molecular weight of the resin included in the THF soluble content is 15,000 to 62,000. When the entire surface integration of an elution curve in GPC obtained by measuring the THF soluble content of the toner is defined as Wand an eluted content corresponding to a flow-out content of 90% to 100% of W with time is defined as F(90-100), the weight average molecular weight of the resin included in the eluted content F(90-100) is preferably 50,000 to 1,500,000, more preferably 100,000 to 1,300,000, and even more preferably 200,000 to 1,100,000. When preferred embodiments are employed, particularly, $T_{f1/2}$ can be easily controlled.

The term "THF soluble content of the toner" described above indicates a component contained in a THF solution (hereinafter, simply referred to as the "THF soluble content), the component obtained by inputting 10 g of the toner in 10 mL of THF (tetrahydrofuran), stirring the resultant mixture for 30 minutes at the condition of 25° C., and then filtering the insoluble content using a membrane filter having a pore size of 0.2 μm. Further, the term "F(90-100)" described above indicates an eluted content corresponding to a time point at which 100% of the eluted content is eluted (that is, a time point at which the entire eluted content is eluted) from a time point at which 90% of the eluted content is eluted after starting elution when the entire surface integration of a GPC chart obtained as the result of analyzing the THF soluble content with GPC is defined as W. Incidentally, as specific measurement conditions of the THF soluble content of the toner and the weight average molecular weight of the resin included in the F(90-100), conditions described in Examples are employed.

The present inventors also found that, when the THF soluble content of the toner and the weight average molecular weight of the resin included in the F(90-100) are each set to the above ranges, fixing temperature dependency of glossiness of the toner can be further reduced.

The resin included in the toner soluble content is derived from the binder resin. Therefore, the fact that the resin included in the THF soluble content of the toner has a specific weight average molecular weight in the F(90-100) means that the resin having a high molecular weight is included in the binder resin. Herein, regarding the toner intended to suppress gloss as in the present invention, as described above, it is important not to occur a case where toner particles are completely melted at the time of heat fixing so that the surface of an image becomes smooth (irregularities are slightly present on the surface of the image).

In this regard, when the binder resin contains the resin having a specific weight average molecular weight in the F(90-100), these resins can partially remain in an aggregated format the time of heat fixing. In other words, owing to these resins, portions which are not compatibilized in some of the binder resin are generated. According to this, it is possible to suppress uniform plasticization of the toner. As a result, even when the fixing temperature increases, the toner is not completely melted, and thus is less likely to become flat. That is, even when heat fixing is performed at a high temperature, the surface of the image is less likely to become smooth, and thus it is speculated that fixing temperature dependency of glossiness can be reduced.

Further, in order to reduce fixing temperature dependency of glossiness of the toner and maintain low temperature fixability, the weight average molecular weight of the resin included in the THF soluble content of the toner is preferably 25,000 to 62,000, more preferably 30,000 to 50,000, and particularly preferably 35,000 to 45,000. From the reason that $T_{f1/2}$ is easily controlled to satisfy the above Formulae (2) and (4), the weight average molecular weight of the resin included in the F(90-100) is more preferably 350,000 to 1,100,000 and particularly preferably 400,000 to 800,000.

The weight average molecular weights of the resin included in the THF soluble content of the toner and the resin included in F(90-100) can be appropriately adjusted by a person skilled in the art. For example, in the production of the binder resin, a method is exemplified in which the polymerization conditions (polymerization temperature, polymerization time, and the like) of the crystalline polyester resin and the amorphous resin are controlled respectively such that the weight average molecular weights become a desired value. Further, a method may be employed in which the crystalline polyester resin and the amorphous resin are prepared in advance, the weight average molecular weights of these resins are measured, and the crystalline polyester resin and the amorphous resin are mixed at an appropriate amount ratio such that the weight average molecular weights become a desired value. In consideration of ease and accuracy of the control of the weight average molecular weight, the latter one is preferably used.

In particular, in order to set the weight average molecular weight of the resin included in F(90-100) to a desired value, the resin having a weight average molecular weight ranging from 100,000 to 1,500,000 (hereinafter, also referred to as the "high-molecular-weight product" or the "high-molecular-weight resin" in some cases) is added preferably in 1 to 30% by mass, more preferably in 2 to 20% by mass, and particularly preferably in 3 to 15% by mass with respect to the total amount (considered to 100% by mass) of the binder resin.

Further, in order to set the weight average molecular weight of the resin included in F(90-100) to a desired value, the weight average molecular weight of the resin constituting the binder resin other than the high-molecular-weight product (that is, the resin included in F(0-less than 90)) is preferably within the range of 5,000 or more but less than 100,000. In addition, the resin is preferably 70 to 99% by mass, more preferably 80 to 98% by mass, and particularly preferably 85 to 97% by mass with respect to the total amount of the binder resin.

The high-molecular-weight product and the resin other than the high-molecular-weight product which are added at this time may be a crystalline polyester resin or an amorphous resin, or may be both of them. Further, the crystalline polyester resin and the amorphous resin which are added as the high-molecular-weight product may be two or more kinds thereof, respectively. Furthermore, the crystalline polyester resin and the amorphous resin which are added as the resin other than the high-molecular-weight product may be two or more kinds thereof, respectively. In this case, the sum of these resins is preferably within the range of the mass ratio described above with respect to the total amount of the binder resin.

Herein, from the following reason, the high-molecular-weight product is preferably an amorphous resin. As described below, the binder resin preferably has a phase separation structure (sea-island structure) in which the crystalline polyester resin forms a disperse phase (domain) and the amorphous resin forms a continuous phase (matrix). If the high-molecular-weight product is an amorphous resin when such a form is employed, the high-molecular-weight product can be contained in the continuous phase. With such a configuration, it is possible to suppress that the continuous phase, and further, the entire binder resin are excessively plasticized at the time of heat fixing. As a result, hot offset resistance and an effect of suppressing gloss can be improved.

Further, the weight average molecular weight of the resin, which constitutes the binder resin, other than the high-molecular-weight product is within the range of 5,000 or more but less than 100,000, and is preferably 70 to 99% by mass, more preferably 80 to 98% by mass, and particularly preferably 85 to 97% by mass with respect to the total amount (considered to 100% by mass) of the binder resin.

<Binder Resin>

The binder resin that constitutes the toner according to the present invention contains a crystalline polyester resin and an amorphous resin. The type, content ratio, or the like of the crystalline polyester resin and the amorphous polyester resin that constitute the binder resin is not particularly limited as long as the toner to be obtained satisfies the relationship represented by the above Formulae (1) to (4).

From the viewpoint of easily obtaining the binder resin for satisfying the physical properties represented by the above Formulae (1) to (4), the content of the crystalline polyester resin is preferably 5 to 45% by mass with respect to the total amount (considered to 100% by mass) of the binder resin. Further, the content of the crystalline polyester resin is more preferably 8 to 40% by mass and particularly preferably 10 to 30% by mass with respect to the total amount of the binder resin. Incidentally, in a case where two or more kinds of the resin are contained as the crystalline polyester resin, the total content thereof is preferably within the mass ratio range described above with respect to the total amount of the binder resin.

On the other hand, the content of the amorphous resin contained in the binder resin is not particularly limited, but is preferably 55 to 95% by mass with respect to the total amount (considered to 100% by mass) of the binder resin. Further, the content of the amorphous resin is more preferably 60 to 92% by mass and particularly preferably 70 to 90% by mass with respect to the total amount of the binder resin. Incidentally, in a case where two or more kinds of resin are contained as the amorphous resin, the sum thereof is preferably within the mass ratio range described above with respect to the total amount of the binder resin. In particular, in a case where the amorphous resin contains the high-molecular-weight product, the total mass of the high-molecular-weight product and the amorphous resin other than the high-molecular-weight product is preferably within the above range.

As a method of isolating or extracting the crystalline polyester resin and the amorphous resin from the toner, for example, the method described in JP 3869968 B1 (a method using a Soxhlet extractor) can be employed, and thus the content ratio can be specified.

When the content of each resin is set to the above range, it is easy to form the phase separation structure (sea-island structure) in which the crystalline polyester resin forms a disperse phase (domain) and the amorphous resin forms a continuous phase (matrix) in the binder resin. In the binder resin having such a structure, since the crystalline polyester resin is easily incorporated into the amorphous resin, exposure of the crystalline polyester resin from the surface of the toner is suppressed. As a result, plasticization of the resin on the surface of the toner particles is less likely to occur at the time of heat fixing and hot offset resistance becomes favorable.

Further, it is speculated that the degradation of electrification of the toner caused by exposure of the crystalline polyester resin from the surface of the toner can be suppressed, and an effect of improving charging uniformity can be also achieved.

Incidentally, the state in which the binder resin has a specific phase separation structure as described above can be checked by, for example, coloring the toner with osmium tetroxide or the like as necessary, and performing scanning electron microscope (SEM) observation or transmission electron microscope (TEM) observation.

Further, the resin contained in the binder resin may contain the crystalline polyester resin and a resin other than the amorphous resin, but from the reason that the binder resin satisfying the relationship represented by the above Formulae (1) to (4) is easily obtained, the binder resin preferably has a form composed of the crystalline polyester resin and the amorphous resin.

(Crystalline Polyester Resin)

The crystalline polyester resin is a known polyester resin obtained by polycondensation reaction of bivalent or higher carboxylic acid (polyvalent carboxylic acid) and bivalent or higher alcohol (polyvalent alcohol), and indicates a resin which does not have a stepwise endothermic change but has a clear endothermic peak in differential scanning calorimetry (DSC) of the toner. The clear endothermic peak specifically means a peak having a half-value width of the endothermic peak of 15° C. or lower when measurement is performed at an increasing rate of 10° C./min in differential scanning calorimetry (DSC) described in Examples. In the present invention, the crystalline polyester resin may be a native polyester resin, a modified polyester resin, or a hybrid polyester resin as long as it is a resin exhibiting thermal properties described above. Such a polyester resin is likely to have a structure with high crystallinity.

The melting point of the crystalline polyester resin is not particularly limited, but is preferably 55° C. to 90° C. When the melting point of the crystalline polyester resin is within the above range, sufficient low temperature fixability is obtained. From such a viewpoint, the melting point thereof is more preferably 60 to 85° C. Incidentally, the melting point of the crystalline polyester resin can be controlled by the resin composition.

The valence of each of the polyvalent carboxylic acid component and the polyvalent alcohol component that constitute the crystalline polyester resin is preferably 2 to 3 and particularly preferably 2. Therefore, a case where each valance is 2 (that is, a dicarboxylic component and a diol component) will be described.

As the dicarboxylic component, aliphatic dicarboxylic acid is preferably used and aromatic dicarboxylic acid may be concurrently used. As the aliphatic dicarboxylic acid, linear aliphatic dicarboxylic acid is preferably used. By using linear aliphatic dicarboxylic acid, there is an advantage that crystallinity is improved. Regarding the dicarboxylic component, there is no limitation on use of one kind thereof, but two or more kinds thereof may be mixed and used.

Examples of the aliphatic dicarboxylic acid include oxalic acid, malonic acid, succinic acid, glutaric acid, adipic acid, pimelic acid, suberic acid, azelaic acid, sebacic acid, 1,9-nonanedicarboxylic acid, 1,10-decanedicarboxylic acid (dodecanedioic acid), 1,11-undecanedicarboxylic acid, 1,12-dodecanedicarboxylic acid (tetradecanedioic acid), 1,13-tridecanedicarboxylic acid, 1,14-tetradecanedicarboxylic acid, 1,16-hexadecanedicarboxylic acid, and 1,18-octadecanedicarboxylic acid.

Among the aliphatic dicarboxylic acids described above, from the viewpoint of easily achieving the effect of the present invention as described above, aliphatic dicarboxylic acid having 6 to 14 carbon atoms is preferable, and aliphatic dicarboxylic acid having 8 to 14 carbon atoms is more preferable.

Examples of the aromatic dicarboxylic acid, which can be used with the aliphatic dicarboxylic acid, include phthalic acid, terephthalic acid, isophthalic acid, orthophthalic acid, t-butyl isophthalic acid, 2,6-naphthalenedicarboxylic acid, and 4,4'-biphenyldicarboxylic acid. Among these, from the viewpoint of availability and readiness in emulsification, it is preferable to use terephthalic acid, isophthalic acid, and t-butyl isophthalic acid.

In addition, polyvalent (trivalent or more) carboxylic acids such as trimellitic acid and pyromellitic acid, and anhydrides or alkyl esters having 1 to 3 carbon atoms of the carboxylic compounds described above, and the like may also be used.

Regarding a dicarboxylic component for forming the crystalline polyester resin, the content of the aliphatic dicarboxylic acid is preferably set to 50 constitution mol % or more, more preferably 70 constitution mol % or more, even more preferably 80 constitution mol % or more, and particularly preferably 100 constitution mol %. When the content of the aliphatic dicarboxylic acid in the dicarboxylic component is set to 50 constitution mol % or more, crystallinity of the crystalline polyester resin can be sufficiently secured.

Further, as a diol component, an aliphatic diol is preferably used, and as necessary, a diol other than the aliphatic diol may be included. As the aliphatic diol, a linear aliphatic diol is preferably used, and when the linear aliphatic diol is used, there is an advantage of improving crystallinity. The diol component may be used alone or in combination of two or more kinds thereof.

Examples of the aliphatic diol include ethylene glycol, 1,2-propanediol, 1,3-propanediol, 1,4-butanediol, 1,5-pentanediol, 1,6-hexanediol, 1,7-heptanediol, 1,8-octanediol, 1,9-nonanediol, 1,10-decanediol, 1,11-undecanediol, 1,12-dodecanediol, 1,13-tridecanediol, 1,14-tetradecanediol, 1,18-octadecanediol, 1,20-eicosanediol, and neopentyl glycol.

As the diol component, among the aliphatic diols, an aliphatic diol having 2 to 12 carbon atoms is preferable, and an aliphatic diol having 3 to 8 carbon atoms is more preferable.

Examples of diols, which are used as necessary, other than aliphatic diols include a diol having a double bond and a diol having a sulfonic acid group. Specific examples of the diol having a double bond include 1,4-butanediol, 2-butene-1,4-diol, 3-butene-1,6-diol, and 4-butene-1,8-diol. In addition, trivalent or higher polyvalent alcohols such as glycerin, pentaerythritol, trimethylol propane, and sorbitol and the like are exemplified.

Regarding a diol component for forming the crystalline polyester resin, the content amount of the aliphatic diol is set to preferably 50 constitution mol % or more, more preferably 70 constitution mol % or more, even more preferably 80 constitution mol % or more, and particularly preferably 100 constitution mol %. When the content amount of the aliphatic diol in the diol component is set to 50 constitution mol % or more, crystallinity of the crystalline polyester resin can be secured, and thus excellent low temperature fixability can be provided to a toner to be produced. In addition, gloss can be provided to an image to be finally formed.

The weight average molecular weight (Mw) of the crystalline polyester resin is preferably 3,000 to 100,000, more preferably 4,000 to 50,000, and particularly preferably 5,000 to 20,000, from the viewpoint of reliably achieving a balance between sufficient low temperature fixability and excellent long-term heat resistance storage stability. Further, the number average molecular weight (Mn) is preferably 3,000 to 100,000, more preferably 4,000 to 50,000, and particularly preferably 5,000 to 20,000.

Regarding the use ratio between the diol component and the dicarboxylic component described above, an equivalent ratio [OH]/[COOH] between a hydroxyl group [OH] of the diol component and a carboxyl group [COOH] of the dicarboxylic component is preferably 2.0/1.0 to 1.0/2.0, more preferably 1.5/1.0 to 1.0/1.5, and particularly preferably 1.2/1.0 to 1.0/1.2. When the equivalent ratio is set to the above range, it is easy to adjust $\Delta H1$, $\Delta H2$, and Tm1 such that $\Delta H1$ and $\Delta H2$ satisfy the relationship represented by the above Formula (1) and Tm1 satisfies the relationship represented by the above Formula (3).

The method for producing the crystalline polyester resin is not particularly limited, and the crystalline polyester resin can be produced by subjecting the polyvalent carboxylic acid and the polyvalent alcohol to polycondensation (esterification) by using a known esterification catalyst.

Examples of a catalyst, which is usable when the crystalline polyester resin is produced, include alkali metal compounds such as sodium and lithium; compounds containing the Group 2 elements such as magnesium and calcium; metal compounds such as aluminum, zinc, manganese, antimony, titanium, tin, zirconium, and germanium; phosphorous acid compounds; phosphate compounds; and amine compound. Specific examples of tin compounds include dibutyl tin oxide, tin octylate, tin dioctylate, and salts of these compounds. Examples of titanium compounds may include titanium alkoxide such as tetra-n-butyl titanate, tetraisopropyl titanate, tetramethyl titanate, or tetrastearyl titanate; titanium acylate such as polyhydroxy titanium stearate; and titanium chelate such as titanium tetra acetylacetonate, titanium lactate, and titanium triethanol aminate. Examples of germanium compounds may include germanium dioxide. Further, examples of aluminum compounds may include oxides such as polyaluminiumhydroxide; and aluminum alkoxide, and tributylaluminate or the like can be exemplified. These compounds may be used alone or in combination of two or more kinds thereof.

The polymerization temperature is not particularly limited, and is preferably 150 to 250° C. Further, the polymerization time is not particularly limited, and is preferably set to 0.5 to 10 hours. In polymerization, as necessary, pressure in the reaction system may be reduced.

(Hybrid Crystalline Polyester Resin (Hybrid Resin))

In the toner of the present invention, the crystalline polyester resin is preferably a resin obtained by chemically binding a crystalline polyester resin unit and an amorphous resin unit other than a polyester resin (in some cases, also referred to as "hybrid resin" or "hybrid crystalline polyester resin" in the present specification). When the resin of such a form is used, the crystalline polyester resin and the amorphous resin are easily compatible with each other in the binder resin, and compatibility is enhanced. As a result, low temperature fixability of the toner is maintained to be favorable. Further, when such a hybrid resin is used, the effect obtained when the binder resin has a phase separation structure is also easily obtained. Owing to the phase separation structure, even when the crystalline polyester resin and the amorphous resin are compatibilized with each other at the time of melting the toner, the crystalline polyester resin is not excessively exposed from the surface of the toner, and thus hot offset properties become favorable.

The crystalline polyester resin unit indicates a portion derived from the crystalline polyester resin. That is, the crystalline polyester resin unit indicates a molecular chain having the same chemical structure as that forming the crystalline polyester resin. In addition, the amorphous resin unit other than the polyester resin indicates a portion derived from the amorphous resin other than the polyester resin. That is, the amorphous resin unit other than the polyester resin indicates a molecular chain having the same chemical structure as that forming the amorphous resin other than the polyester resin.

The binding form of the hybrid resin is not particularly limited. For example, the hybrid resin may have a form obtained by block copolymerization having the crystalline polyester resin unit and the amorphous resin unit (block copolymer), or may have a form obtained by binding the side chain of the crystalline polyester resin unit to the main chain of the amorphous resin unit (graft copolymer) or a reverse form. Among these, the hybrid resin is preferably a graft copolymer having the amorphous resin unit as a main chain and the crystalline polyester resin unit as a side chain. That is, the hybrid resin is preferably a graft copolymer having a comb-shaped structure including the amorphous resin unit as a stem and the crystalline polyester resin unit as a branch.

When the hybrid resin is such a graft copolymer, orientations of the crystalline polyester resin units are easily arranged in one direction and the crystalline polyester resin units are easily oriented densely. For these reasons, it is possible to impart crystallinity to the hybrid resin. As a result, crystallinity of the binder resin in the toner is improved. Therefore, the toner according to the present invention exhibits excellent low temperature fixability. In addition, when the hybrid resin is in the form of the graft copolymer described above, ΔH1 and ΔH2 are easily controlled to satisfy the relationship represented by the above Formula (1).

The weight average molecular weight (Mw) of the hybrid resin is preferably 3,000 to 100,000, more preferably 4,000 to 50,000, and particularly preferably 5,000 to 20,000 from the viewpoint of reliably achieving both of sufficient low temperature fixability and excellent long-term heat resistance storage stability. In addition, the number average molecular weight (Mn) is preferably 3,000 to 100,000, more preferably 4,000 to 50,000, and particularly preferably 5,000 to 20,000.

Incidentally, a substituent such as a sulfonic acid group, a carboxyl group, or a urethane group may be further introduced to the hybrid resin contained in the binder resin. The substituent described above may be introduced into the crystalline polyester resin unit or the amorphous resin unit other than the polyester resin.

<<Crystalline Polyester Resin Unit>>

The crystalline polyester resin unit is the same as the crystalline polyester resin, and is a portion derived from a known polyester resin obtained by polycondensation reaction of the same polyvalent carboxylic acid and polyvalent alcohol. The crystalline polyester resin unit is not particularly limited as long as it has the definition as described above. For example, regarding a resin having a structure obtained by copolymerizing other components with the main chain composed of the crystalline polyester resin unit or a resin having a structure obtained by copolymerizing the crystalline polyester resin unit with the main chain composed of other components, if the toner containing this resin exhibits a clear endothermic peak as described above, the relevant resin corresponds to the hybrid resin having a crystalline polyester resin unit described in the present invention.

Since the polyvalent carboxylic acid component and the polyvalent alcohol component constituting the crystalline polyester resin unit are the same as in the crystalline polyester resin described above, the description thereof is omitted.

The content of the crystalline polyester resin unit is preferably more than 65% by mass but equal to or less than 95% by mass with respect to the total amount (considered to 100% by mass) of the hybrid resin. Further, the content thereof is more preferably more than 70% by mass but equal to or less than 90% by mass, and particularly preferably more than 75% by mass but equal to or less than 88% by mass.

When the content is set to the above range, sufficient crystallinity can be imparted to the hybrid resin, and it is easy to obtain the binder resin for satisfying the relationship represented by the above Formula (1). ΔH1 and ΔH2 depend on the content ratio of the hybrid resin and the amorphous resin in the binder resin, the chemical structures of the crystalline polyester resin unit and the amorphous resin unit, or the like. In particular, when the content ratio of the amorphous resin unit in the hybrid resin is set within the above range, it is possible to easily obtain the binder resin for satisfying the relationship represented by the above Formula (1).

Incidentally, the structural component and the content ratio of each unit in the hybrid resin can be specified by, for example, NMR measurement or methylation reaction P-GC/MS measurement.

Further, the crystalline polyester resin unit may be subjected to polycondensation with a compound to be chemically bound to the amorphous resin unit in addition to the polyvalent carboxylic acid and the polyvalent alcohol. As described later in detail, the amorphous resin unit is preferably a vinyl resin unit, but a compound to be subjected to addition polymerization with such a resin unit. Therefore, the crystalline polyester resin unit can be subjected to polycondensation with respect to the polyvalent carboxylic acid and the polyvalent alcohol, and a compound having an unsaturated bond (preferably a double bond) is preferably further polymerized. Examples of such a compound include polyvalent carboxylic acid having a double bond such as methylenesuccinic acid or acrylic acid; and polyvalent alcohol having a double bond.

The content ratio of the constitutional unit derived from the above-described compound in the crystalline polyester resin unit is preferably 0.5 to 20% by mass with respect to the total amount of the crystalline polyester resin unit. Examples of such a compound include polyvalent carboxylic acid having a double bond such as methylenesuccinic acid; and polyvalent alcohol having a double bond.

Incidentally, a substituent such as a sulfonic acid group, a carboxyl group, or a urethane group may be introduced in the hybrid resin. The introduction position of the substituent may be the inside of the crystalline polyester resin unit or the inside of the amorphous resin unit other than the polyester resin to be described later in detail. Incidentally, those obtained by introducing the substituent as described above in a crystalline polyester resin which is not subjected to hybridization are not included in the hybrid crystalline polyester resin of the present invention.

<<Amorphous Resin Unit Other than Polyester Resin>>

The amorphous resin unit other than the polyester resin (incidentally, in the present specification, simply referred to as the "amorphous resin unit" in some cases) contributes to improvement in affinity between the amorphous resin constituting the binder resin and the hybrid resin. When the amorphous resin unit is present, affinity between the hybrid resin and the amorphous resin is improved and compatibility between the hybrid resin and the amorphous resin can be easily controlled.

The amorphous resin unit is a portion derived from the amorphous resin other than the polyester resin. The state in which the amorphous resin unit is contained in the hybrid resin (further, in the toner) can be checked by specifying the chemical structure by using, for example, NMR measurement or methylation reaction P-GC/MS measurement.

Further, when differential scanning calorimetry (DSC) is performed on the resin having the same chemical structure and molecular weight as those of the relevant unit, the amorphous resin unit does not have a melting point and is a resin unit having a relatively high glass transition temperature (Tg). At this time, regarding the resin having the same chemical structure and molecular weight as those of the relevant unit, the glass transition temperature (Tg1) in the first heating process in DSC measurement is preferably 30 to 80° C. and particularly preferably 40 to 65° C. Incidentally, the glass transition temperature (Tg1) can be measured by the method described in Examples.

The amorphous resin unit is not particularly limited as long as it has the definition as described above. For example, regarding a resin having a structure in which another component is copolymerized to the main chain of the amorphous resin unit or a resin having a structure in which the amorphous resin unit is copolymerized to the main chain of another component, when the toner containing this resin has the amorphous resin unit as described above, this resin corresponds to the hybrid resin having the amorphous resin unit described in the present invention.

The content of the amorphous resin unit is preferably 5% by mass or more but less than 35% by mass with respect to the total amount (considered to 100% by mass) of the hybrid resin. Further, the content thereof is more preferably 10% by mass or more but less than 30% by mass, and even more preferably 12% by mass or more but less than 25% by mass. When the content is set to the above range, sufficient crystallinity can be imparted to the hybrid resin and it is possible to obtain the binder resin for satisfying the relationship represented by the above Formula (1). Incidentally, ΔH1 and ΔH2 depend on the content ratio of the crystalline polyester resin (hybrid resin) and the amorphous resin in the binder resin, the chemical structures of the crystalline polyester resin unit and the amorphous resin unit, or the like. However, when the content ratio of the amorphous resin unit in the hybrid resin is set within the above range, it is possible to easily obtain the binder resin for satisfying the relationship represented by the above Formula (1).

The amorphous resin unit is preferably composed of the same kind of resin as the amorphous resin contained in the binder resin (that is, the resin other than the crystalline polyester resin (hybrid resin)). When the amorphous resin unit has such a form, affinity between the hybrid resin and the amorphous resin is further improved, the hybrid resin is further easily incorporated into the amorphous resin, and compatibility is easily controlled. In addition, the values of ΔH1 and ΔH2 are easily controlled.

Herein, the term "the same kind of resin" means that a characteristic chemical bond is commonly included in repeating units. Herein, the term "characteristic chemical bond" conforms to "Polymer Classification" described in Materials Database of National Institute for Materials Science (NIMS) (http://polymer.nims.go.jp/PoLyInfo/guide/jp/term_polymer.html). That is, the chemical structure constituting polymers classified into 22 kinds in total (that is, polyacryl, polyamide, polyacid anhydride, polycarbonate, polydiene, polyester, polyhaloolefin, polyimide, polyimine, polyketone, polyolefin, polyether, polyphenylene, polyphosphazene, polysiloxane, polystyrene, polysulfide, polysulfone, polyurethane, polyurea, polyvinyl, and other polymers) is referred to as the "characteristic chemical bond."

Further, the term "the same kind of resin" in a case where the resin is a copolymer indicates resins commonly having the characteristic chemical bond in a case where a monomer species having the above-described chemical bond is used as the constitutional unit in the chemical structure of a plurality of monomer species constituting the copolymer. Therefore, even in a case where characteristics exhibited by each resin itself are different from each other or a case where the mole component ratios of the monomer species constituting the copolymer are different from each other, the resins are considered to be the same kind of resins as long as they commonly have a characteristic chemical bond.

For example, since a resin (or a resin unit) formed by styrene, butyl acrylate, and acrylic acid and a resin (or a resin unit) formed by styrene, butyl acrylate, and methacrylic acid have a chemical bond forming at least polyacryl, these resins correspond to the same kind of resins.

The resin component constituting the amorphous resin unit is not particularly limited, and examples thereof include a vinyl resin unit, a urethane resin unit, and a urea resin unit. Among them, from the reason that thermoplasticity is easily controlled, a vinyl resin unit is particularly preferable.

The vinyl resin unit is not particularly limited as long as it is obtained by polymerizing a vinyl compound, and examples thereof include an acrylic acid ester resin unit, a styrene-acrylic acid ester resin unit, and an ethylene-vinyl acetate resin unit. These may be used alone or in combination of two or more kinds thereof.

Among the vinyl resin units described above, in consideration of plasticity at the time of heat fixing, a styrene-acrylic acid ester resin unit (styrene-acrylic resin unit) is preferable. Therefore, hereinafter, a styrene-acrylic resin unit as an amorphous resin unit will be described.

The styrene-acrylic resin unit is formed by subjecting a styrene monomer and a (meth)acrylic acid ester monomer to addition polymerization. The styrene monomer described herein includes a monomer with a structure having a known side chain or functional group in the styrene structure in addition to styrene represented by the structural formula: $CH_2{=}CH{-}C_6H_5$. Further, the (meth)acrylic acid ester monomer described herein includes an ester compound having known side chain or functional group in a structure such as an acrylic acid ester derivative or a methacrylic acid ester derivative in addition to an acrylic acid ester compound or a methacrylic acid ester compound represented by $CH_2{=}CHCOOR$ (R is an alkyl group).

Hereinafter, specific examples of the styrene monomer and the (meth)acrylic acid ester monomer which can form the styrene-acrylic resin unit will be described, but these examples are not particularly limited as long as they can be used for forming the styrene-acrylic resin unit used in the present invention.

First, specific examples of the styrene monomer include styrene, o-methylstyrene, m-methylstyrene, p-methylstyrene, α-methylstyrene, p-phenylstyrene, p-ethylstyrene, 2,4-dimethylstyrene, p-tert-butylstyrene, p-n-hexylstyrene, p-n-octylstyrene, p-n-nonylstyrene, p-n-decylstyrene, and p-n-dodecylstyrene. These styrene monomers may be used alone or in combination of two or more kinds thereof.

Further, specific examples of the (meth)acrylic acid ester monomer include acrylic acid ester monomers such as methyl acrylate, ethyl acrylate, isopropyl acrylate, n-butyl acrylate, t-butyl acrylate, isobutyl acrylate, n-octyl acrylate, 2-ethylhexyl acrylate, stearyl acrylate, lauryl acrylate, and phenyl acrylate; and methacrylic acid esters such as methyl methacrylate, ethyl methacrylate, n-butyl methacrylate, isopropyl methacrylate, isobutyl methacrylate, t-butyl methacrylate, n-octyl methacrylate, 2-ethylhexyl methacrylate, stearyl methacrylate, lauryl methacrylate, phenyl methacrylate, diethylamino ethyl methacrylate, and dimethylamino ethyl methacrylate.

Incidentally, the "acrylic acid ester monomer" and the "methacrylic acid ester monomer" are collectively referred to as the term "(meth)acrylic acid ester monomer" in the present specification, and for example, "methyl acrylate" and "methyl methacrylate" are collectively referred to as the term "methyl (meth)acrylate."

These acrylic acid ester monomer and methacrylic acid ester monomer can be used alone or in combination of two or more kinds thereof. That is, it is possible to form a copolymer by using a styrene monomer and two or more kinds of acrylic acid ester monomer, to form a copolymer by using a styrene monomer and two or more kinds of methacrylic acid ester monomer, or to form a copolymer by concurrently using a styrene monomer, an acrylic acid ester monomer, and a methacrylic acid ester monomer.

The content ratio of the constitutional unit derived from the styrene monomer in the amorphous resin unit is preferably 40 to 90% by mass with respect to the total amount of the amorphous resin unit. Further, the content ratio of the constitutional unit derived from the (meth)acrylic acid ester monomer in the amorphous resin unit is preferably 10 to 80% by mass with respect to the total amount of the amorphous resin unit. When the content ratio is set to such a range, plasticity of the hybrid resin is easily controlled.

Furthermore, the amorphous resin unit is preferably formed by addition polymerization with a compound for chemical bonding to the crystalline polyester resin unit, in addition to the styrene monomer and the (meth)acrylic acid ester monomer. Specifically, it is preferable to use a compound to be ester-bonded to a hydroxyl group [—OH] derived from the polyvalent alcohol or a carboxyl group [—COOH] derived from the polyvalent carboxylic acid included in the crystalline polyester resin unit. Therefore, the amorphous resin unit is preferably formed by further polymerizing a compound which can be subjected to addition polymerization with respect to the styrene monomer and the (meth)acrylic acid ester monomer and has a carboxyl group [—COOH] or a hydroxyl group [—OH].

Examples of such a compound include a compound having a carboxyl group such as acrylic acid, methacrylic acid, maleic acid, itaconic acid, cinnamate, fumaric acid, maleic acid monoalkyl ester, or itaconic acid monoalkyl ester; and a compound having a hydroxyl group such as 2-hydroxyethyl(meth)acrylate, 2-hydroxypropyl(meth)acrylate, 3-hydroxypropyl(meth)acrylate, 2-hydroxybutyl(meth) acrylate, 3-hydroxybutyl(meth)acrylate, 4-hydroxybutyl (meth)acrylate, or polyethylene glycol mono(meth)acrylate.

The content ratio of the constitutional unit derived from the above-described compound in the amorphous resin unit is preferably 0.5 to 20% by mass with respect to the total amount of the amorphous resin unit.

The method for forming the styrene-acrylic resin unit is not particularly limited, and a method of polymerizing a monomer by using a known oil-soluble or water-soluble polymerization initiator is exemplified. Specific examples of the oil-soluble polymerization initiator include an azo-based or diazo-based polymerization initiator and a peroxide-based polymerization initiator to be described below.

Examples of the azo-based or diazo-based polymerization initiator include 2,2'-axobis-(2,4-dimethylvaleronitrile), 2,2'-azobisisobutyronitrile, 1,1'-azobis(cyclohexane-1-carbonitrile), 2,2'-axobis-4-methoxy-2,4-dimethylvaleronitrile, and azobisisobutyronitrile.

Examples of the peroxide-based polymerization initiator include benzoyl peroxide, methyl ethyl ketone peroxide, diisopropylperoxycarbonate, cumene hydroperoxide, t-butyl hydroperoxide, di-t-butyl peroxide, dicumyl peroxide, 2,4-dichlorobenzoyl peroxide, lauroyl peroxide, 2,2-bis-(4,4-t-butylperoxycyclohexyl)propane, and tris-(t-butylperoxy)triazine.

Further, water-soluble radical polymerization initiators are usable in a case where resin particles are formed by an emulsion polymerization method. Examples of the water-soluble polymerization initiators include persulfates such as potassium persulfate and ammonium persulfate, an azobisaminodipropane acetic acid salt, azobiscyanovaleric acid and a salt thereof, and hydrogen peroxide.

<<Method for Producing Hybrid Crystalline Polyester Resin (Hybrid Resin)>>

The method for producing the hybrid resin containing the binder resin according to the present invention is not particularly limited as long as it is a method capable of forming a polymer having a structure in which the crystalline polyester resin unit and the amorphous resin unit are molecularly bonded to each other. Specific examples of the method for producing the hybrid resin include a method to be described below.

(a) Method for Producing Hybrid Resin by Polymerizing Amorphous Resin Unit in Advance and Performing Polymerization Reaction which Forms Crystalline Polyester Resin Unit in Presence of Relevant Amorphous Resin Unit In this method, first, the monomers constituting the amorphous resin unit described above (preferably, vinyl monomers such as a styrene monomer and a (meth)acrylic acid ester monomer) are reacted to form an amorphous resin unit. Next, polyvalent carboxylic acid and polyvalent alcohol are subjected to polymerization reaction in the presence of the amorphous resin unit to form a crystalline polyester resin unit. At this time, by subjecting polyvalent carboxylic acid and polyvalent alcohol to condensation reaction and reacting polyvalent carboxylic acid or polyvalent alcohol with respect to the amorphous resin unit, a hybrid resin is formed.

In the above-described method, a site in which these units can react with each other is preferably incorporated into the crystalline polyester resin unit or the amorphous resin unit. Specifically, at the time of forming the amorphous resin unit, in addition to the monomers constituting the amorphous resin unit, a compound having a site which can react with a carboxy group [—COOH] or a hydroxyl group [—OH] remaining in the crystalline polyester resin unit and a site which can react with the amorphous resin unit is also used. That is, when this compound reacts with a carboxy group [—COOH] or a hydroxyl group [—OH] in the crystalline polyester resin unit, the crystalline polyester resin unit can be chemically bonded to the amorphous resin unit.

Alternatively, a compound having a site which can react with polyvalent alcohol or polyvalent carboxylic acid and can react with the amorphous resin unit may be used at the time of forming the crystalline polyester resin unit.

By using the method described above, a hybrid resin having a structure in which the crystalline polyester resin unit is molecularly bonded to the amorphous resin unit (graft structure) can be formed.

(b) Method for Producing Hybrid Resin by Respectively Forming Crystalline Polyester Resin Unit and Amorphous Resin Unit and then Binding these Resin Units In this method, first, polyvalent carboxylic acid and polyvalent alcohol are subjected to condensation reaction to form a crystalline polyester resin unit. Further, separately from a reaction system that forms the crystalline polyester resin unit, the monomers constituting the amorphous resin unit described above are polymerized to form an amorphous resin unit. At this time, it is preferable to incorporate a site in which the crystalline polyester resin unit and the amorphous resin unit can react with each other. Incidentally, the method of incorporating such a reactable site is as described above, and thus detailed description thereof is omitted.

Next, the crystalline polyester resin unit and the amorphous resin unit, which are formed above, are reacted with each other so that a hybrid resin having a structure in which the crystalline polyester resin unit and the amorphous resin unit are molecularly bonded to each other can be formed.

Further, in a case where the reactable site is not incorporated into the crystalline polyester resin unit and the amorphous resin unit, a method may be employed in which a system in which the crystalline polyester resin unit and the amorphous resin unit coexist is formed and a compound having a site which can be bonded to the crystalline polyester resin unit and the amorphous resin unit is put into the system. Further, through the compound, the hybrid resin having a structure in which the crystalline polyester resin unit and the amorphous resin unit are molecularly bonded to each other can be formed.

Of the forming methods (a) and (b) described above, the method (a) is preferable since a hybrid resin having a structure in which the crystalline polyester resin chain is grafted to the amorphous resin chain is easily formed and production processes can be simplified. In addition, in the method (a), since the amorphous resin unit is formed in advance and then the crystalline polyester resin unit is bonded thereto, the orientation of the crystalline polyester resin unit is likely to be uniform. Therefore, since a hybrid resin suitable for the toner defined in the present invention can be reliably formed, the method (a) is preferable.

(Amorphous Resin)

A conventionally known amorphous resin in the field of the present technique is used as the amorphous resin.

The amorphous resin forms the binder resin together with the hybrid resin. The amorphous resin is not particularly limited, but the amorphous resin is a resin not having a melting point and having a relatively high glass transition temperature (Tg) when differential scanning calorimetry (DSC) is performed on the resin. Incidentally, when a glass transition temperature in the first heating process in the DSC measurement is defined as Tg1, Tg1 of the amorphous resin is preferably 35 to 80° C. and particularly preferably 45 to 65° C. Incidentally, the glass transition temperature (Tg1) can be measured by the method described in Examples.

The weight average molecular weight (Mw) of the amorphous resin is preferably 5,000 or more but less than 100,000, more preferably 10,000 to 80,000, and particularly preferably 15,000 to 60,000 from the viewpoint of controlling the value of $T_{f1/2}$ and plasticity described above.

Herein, the amorphous resin preferably contains a resin as the above-described high-molecular-weight product. That is, the amorphous resin constituting the binder resin preferably contains the high-molecular-weight product and a resin having a higher weight average molecular weight than the high-molecular-weight product. At this time, the content of the high-molecular-weight product is preferably 1 to 30% by mass and more preferably 2 to 20% by mass with respect to the total amount (considered to 100% by mass) of the amorphous resin. When the amorphous resin contains the high-molecular-weight product at the content ratio, it is possible to reduce fixing temperature dependency of glossiness.

The amorphous resin preferably contains a resin component constituting the unit described in the section <<Amorphous Resin Unit other than Polyester Resin>>. That is, the amorphous resin is preferably a vinyl resin, a urethane resin, a urea resin, or the like, and a vinyl resin is particularly preferable.

Particularly, in a case where the amorphous resin unit of the hybrid resin as the crystalline polyester resin is a vinyl resin unit, the vinyl resin is preferable in terms of easily controlling compatibility with the hybrid resin and easily controlling the values of ΔH1 and ΔH2. Therefore, hereinafter, the vinyl resin will be described.

<<Vinyl Resin>>

When the vinyl resin is used as the amorphous resin, the vinyl resin is not particularly limited as long as it is formed by polymerizing the vinyl compound, but examples thereof include an acrylic acid ester resin, a styrene-acrylic acid ester resin, and an ethylene-vinyl acetate resin. These may be used alone or in combination of two or more kinds thereof.

Among the vinyl resins described above, in consideration of plasticity at the time of heat fixing, a styrene-acrylic acid ester resin (styrene-acrylic resin) is preferable.

As the monomer constituting the styrene-acrylic resin, it is possible to use the same compound as the compound exemplified as the monomer constituting the styrene-acrylic resin unit in the section <<Amorphous Resin Unit other than Polyester Resin>>.

Therefore, detailed description is omitted, but it is preferable to use, as a styrene monomer, styrene, o-methylstyrene, m-methylstyrene, p-methylstyrene, α-methylstyrene, p-phenylstyrene, or p-ethylstyrene; as a (meth)acrylic acid ester monomer, an acrylic acid ester monomer such as methyl acrylate, ethyl acrylate, isopropyl acrylate, n-butyl acrylate, or isobutyl acrylate; and a methacrylic acid ester such as methyl methacrylate, ethyl methacrylate, n-butyl methacrylate, isopropyl methacrylate, or isobutyl methacrylate. These styrene monomers and (meth)acrylic acid ester monomers can be used alone or in combination of two or more kinds thereof.

Further, another monomer may be polymerized, and examples thereof include acrylic acid, methacrylic acid, maleic acid, itaconic acid, cinnamate, fumaric acid, maleic acid monoalkyl ester, itaconic acid monoalkyl ester, 2-hydroxyethyl(meth)acrylate, 2-hydroxypropyl(meth)acrylate, 3-hydroxypropyl(meth)acrylate, 2-hydroxybutyl(meth)acrylate, 3-hydroxybutyl(meth)acrylate, 4-hydroxybutyl(meth)acrylate, and polyethylene glycol mono(meth)acrylate.

The content ratio of the constitutional unit derived from the styrene monomer in the styrene-acrylic resin is preferably 40 to 90% by mass with respect to the total amount of the styrene-acrylic resin. In addition, the content ratio of the constitutional unit derived from the (meth)acrylic acid ester monomer in the styrene-acrylic resin is preferably 10 to 60% by mass with respect to the total amount of the styrene-acrylic resin. When the content ratio is set to such a range, plasticity of the amorphous resin is easily controlled.

The content ratio of the constitutional unit derived from another monomer described above in the styrene-acrylic resin is preferably 0.5 to 30% by mass with respect to the total amount of the styrene-acrylic resin.

The method for producing the styrene-acrylic resin is not particularly limited, but the styrene-acrylic resin can be formed by the same method for forming the styrene-acrylic resin unit described in the section <<Amorphous Resin Unit other than Polyester Resin>>. When the high-molecular-weight product is the styrene-acrylic resin, the polymerization average molecular weight can be controlled by the added amount of a chain transfer agent to be described later, or the like.

(Form of Binder Resin)

The binder resin included in the toner of the present invention may have any forms (forms of resin particles) as long as it contains the hybrid resin and the amorphous resin.

For example, the resin particles (binder resin particles) formed by the binder resin may be particles having a so-called single layer structure or may be particles having a core-shell structure (a form in which a resin forming a shell portion is aggregated and fused on a surface of a core particle).

<Other Components>

In addition to the essential components described above, an internal additive such as a releasing agent, a colorant, or a charge control agent; and an external additive such as inorganic particles, organic particles, or a lubricant may be contained in the toner of the present invention, as necessary.

(Releasing Agent (Wax))

The releasing agent constituting the toner is not particularly limited, but known releasing agents can be used. Specific examples thereof include polyolefin wax such as polyethylene wax or polypropylene wax; branched-chain hydrocarbon wax such as microcrystalline wax; long-chain hydrocarbon-based wax such as paraffin wax or Sasol wax; dialkyl ketone-based wax such as distearyl ketone; ester-based wax such as carnauba wax, montan wax, behenyl behenate, trimethylolpropane tribehenate, pentaerythritol tetrabehenate, pentaerythritol diacetate dibehenate, glycerin tribehenate, 1,18-octadecanediol distearate, trimellitic acid tristearyl, or distearyl maleate; and amide-based wax such as ethylenediamine behenylamide or trimellitic acid tristearylamide.

The melting point of the releasing agent is preferably 40 to 160° C. and more preferably 50 to 120° C. When the melting point is set within the above range, the heat resistance storage property of the toner is secured, and a toner image can be stably formed without causing cold offset even in a case where fixing is performed at a low temperature. Further, the content of the releasing agent in the toner is preferably 1 to 30% by mass and more preferably 5 to 20% by mass.

<Colorant>

As a colorant which may constitute the toner, carbon black, a magnetic body, a dye, a pigment, and the like can be arbitrarily used, and as the carbon black, channel black, furnace black, acetylene black, thermal black, lampblack, or the like is used. As the magnetic body, ferromagnetic metal such as iron, nickel, or cobalt, an alloy containing these metals, a compound of ferromagnetic metal such as ferrite or magnetite, an alloy which does not contain ferromagnetic metal but exhibits ferromagnetic property through heat treatment (for example, various alloys that are called Heusler alloy such as manganese-copper-aluminum or manganese-copper-tin), chromium dioxide, and the like can be used.

As a black colorant, for example, carbon black such as furnace black, channel black, acetylene black, thermal black, or lampblack, and also magnetic powder of magnetite or ferrite are usable.

Examples of colorants for magenta or red include C. I. Pigment Red 2, C. I. Pigment Red 3, C. I. Pigment Red 5, C. I. Pigment Red 6, C. I. Pigment Red 7, C. I. Pigment Red 15, C. I. Pigment Red 16, C. I. Pigment Red 48:1, C. I. Pigment Red 53:1, C. I. Pigment Red 57:1, C. I. Pigment Red 60, C. I. Pigment Red 63, C. I. Pigment Red 64, C. I. Pigment Red 68, C. I. Pigment Red 81, C. I. Pigment Red 83, C. I. Pigment Red 87, C. I. Pigment Red 88, C. I. Pigment Red 89, C. I. Pigment Red 90, C. I. Pigment Red 112, C. I. Pigment Red 114, C. I. Pigment Red 122, C. I. Pigment Red 123, C. I. Pigment Red 139, C. I. Pigment Red 144, C. I. Pigment Red 149, C. I. Pigment Red 150, C. I. Pigment Red 163, C. I. Pigment Red 166, C. I. Pigment Red 170, C. I. Pigment Red 177, C. I. Pigment Red 178, C. I. Pigment Red 184, C. I. Pigment Red 202, C. I. Pigment Red 206, C. I. Pigment Red 207, C. I. Pigment Red 209, C. I. Pigment Red 222, C. I. Pigment Red 238, and C. I. Pigment Red 269.

Further, examples of colorants for orange or yellow include C. I. Pigment Orange 31, C. I. Pigment Orange 43, C. I. Pigment Yellow 12, C. I. Pigment Yellow 14, C. I. Pigment Yellow 15, C. I. Pigment Yellow 17, C. I. Pigment Yellow 74, C. I. Pigment Yellow 83, C. I. Pigment Yellow 93, C. I. Pigment Yellow 94, C. I. Pigment Yellow 138, C. I. Pigment Yellow 155, C. I. Pigment Yellow 162, C. I. Pigment Yellow 180, and C. I. Pigment Yellow 185.

Furthermore, examples of colorants for green or cyan include C. I. Pigment Blue 2, C. I. Pigment Blue 3, C. I. Pigment Blue 15, C. I. Pigment Blue 15:2, C. I. Pigment Blue 15:3, C. I. Pigment Blue 15:4, C. I. Pigment Blue 16, C. I. Pigment Blue 17, C. I. Pigment Blue 60, C. I. Pigment Blue 62, C. I. Pigment Blue 66, and C. I. Pigment Green 7.

These colorants can be used alone or two or more kinds thereof can be selected and used in combination, as necessary.

The added amount of the colorant is preferably in the range of 1 to 30% by mass and more preferably in the range of 2 to 20% by mass with respect to the entire toner, and a mixed product of these colorants can also be used. When the added amount is in such a range, color reproducibility of the image can be secured.

Further, the size of the colorant is 10 to 1000 nm in terms of the volume average particle diameter, and is preferably 50 to 500 nm and particularly preferably 80 to 300 nm.

<Charge Control Agent>

As a charge control agent, known various compounds such as nigrosine-based dyes, metal salts of naphthenic acid or higher fatty acid, an alkoxylated amine, a quaternary ammonium salt compound, an azo-based metal complex, and a salicylic acid metal salt can be used.

The added amount of the charge control agent is generally 0.1 to 10% by mass and preferably 0.5 to 5% by mass with respect to 100% by mass of the binder resin in toner particles to be finally obtained.

The size of particles of the charge control agent is 10 to 1000 nm in terms of the number average primary particle diameter, and is preferably 50 to 500 nm and particularly preferably 80 to 300 nm.

<External Additive>

From the viewpoint of improving electrostatic-charging performance, flowability, or cleaning properties of the toner, particles such as known inorganic particles or organic particles, or lubricants can be added as an external additive to the surface of the toner particles.

As the inorganic particles, inorganic particles of silica, titania, alumina, strontium titanate, or the like may be exemplified as a preferred example.

These inorganic particles may be subjected to hydrophobizing treatment as necessary.

As the organic particles, spherical organic particles having a number average primary particle diameter of about 10 to 2000 nm can be used. Specifically, organic particles of homopolymers, such as styrene and methyl methacrylate, or copolymers thereof can be used.

The lubricant is used for the purpose of further improving cleaning properties and transferring properties, and examples of the lubricant include metal salts of higher fatty acids such as stearic acid salts such as zinc stearate, aluminum stearate, copper stearate, magnesium stearate, and calcium stearate; oleic acid salts such as zinc oleate, manganese oleate, iron oleate, copper oleate, and magnesium oleate; palmitic acid salts such as zinc palmitate, copper palmitate, magnesium palmitate, and calcium palmitate; linolic acid salts such as zinc linolate and calcium linolate; and ricinoleic acid salts such as zinc ricinoleate and calcium ricinoleate. These various external additives may be used in combination of various kinds thereof.

The added amount of the external additive is preferably 0.1 to 10.0% by mass with respect to 100% by mass of the toner particles.

Examples of a method of adding an external additive include a method of adding an external additive by using various known mixing apparatuses such as a turbulent mixer, a Henschel mixer, a nauter mixer, and a V-type mixer.

[Electrostatic Image Developing Toner (Toner)]

The average particle diameter of the toner of the present invention is 3.0 to 8.0 μm in terms of the volume average particle diameter and is preferably 4.0 to 7.5 μm. When the average particle diameter is within the above range, toner particles with great attachment power which are flown to be attached to a heating member at the time of fixing, causing fitting offset are reduced, and the transfer efficiency is enhanced so that halftone image quality is improved. Thus, image quality of fine lines or dots is improved. In addition, toner flowability can also be secured.

The average particle diameter of the toner can be controlled by the concentration of an aggregating agent, the added amount of a solvent, or the aggregating time in the aggregating/fusing step at the time of producing the toner, and the composition of the binder resin.

The average circularity represented by the following Mathematical Formula 1 of the electrostatic image developing toner of the present invention is preferably 0.920 to 1.000 and more preferably 0.940 to 0.995, from the viewpoint of improving transfer efficiency.

[Math. 3]

Average circularity=boundary length of circle obtained from equivalent circle diameter/boundary length of particle projection imageMathematical Formula 1

Incidentally, the average circularity can be measured by using, for example, an average circularity measurement apparatus "FDDA-2100" (manufactured by Sysmex Corporation).

<Method for Producing Toner of Present Invention>

The method for producing the toner of the present invention is not particularly limited, and examples thereof include known methods such as a kneading pulverization method, a suspension polymerization method, an emulsion aggregation method, a dissolution suspension method, a polyester elongation method, and a dispersion polymerization method.

Among these, from the viewpoint of uniformity of the particle diameter, controllability of the shape, and ease of the core-shell structure formation, it is preferable to employ an emulsion aggregation method. Hereinafter, the emulsion aggregation method will be described.

(Emulsion Aggregation Method)

The emulsion aggregation method is a method in which a dispersion liquid of fine particles of the resin (hereinafter, also referred to as "resin fine particles") dispersed by a surfactant or a dispersion stabilizer is mixed with a dispersion liquid of a toner particle constituent component such as fine particles of a colorant, aggregating is carried out by adding an aggregating agent until a desired toner particle diameter is obtained, fusing between the resin fine particles is carried out after the aggregating or at the same time of the aggregating, and then the shape control is carried out, thereby forming toner particles.

Herein, regarding resin fine particles, composite particles formed by a plurality of layers which are formed by resins each having a different composition and have a structure of two or more layers can also be used.

The resin fine particles can be produced by, for example, an emulsion polymerization method, a mini-emulsion polymerization method, a phase inversion emulsification method, or the like, or can be produced by combining several methods. In a case where an internal additive is contained in the resin fine particles, a mini-emulsion polymerization method is preferably used.

In a case where an internal additive is contained in the toner particles, resin fine particles may contain the internal additive. Alternatively, a dispersion liquid of internal additive fine particles composed of only an internal additive is separately prepared, and the internal additive fine particles may be aggregated when the resin fine particles are aggregated.

Further, according to the emulsion aggregation method, toner particles having a core-shell structure can be obtained. Specifically, toner particles having a core-shell structure can be obtained in such a manner that binder resin fine particles for core particles and a colorant are aggregated (fused) to prepare core particles, binder resin fine particles for a shell portion are then added into a dispersion liquid of core particles, and the binder resin fine particles for a shell portion are aggregated and fused on the surface of core particles to form a shell portion that covers the surface of core particles.

In a case where the toner is produced by the emulsion aggregation method, a method of producing a toner according to the preferred embodiment is the method for producing the electrostatic image developing toner described above, and includes a step of dispersing a crystalline polyester resin and an amorphous resin in a water-based medium to prepare a dispersion liquid and a step of aggregating and fusing the crystalline polyester resin and the amorphous resin in the dispersion liquid.

The method for producing a toner according to the further preferred embodiment includes a step (a) of dispersing fine particles of a crystalline polyester resin and fine particles of an amorphous resin in a water-based medium to prepare a dispersion liquid (hereinafter, also referred to as the "dispersion liquid preparation step") and a step (b) of mixing the dispersion liquid of crystalline polyester resin fine particles and the dispersion liquid of amorphous resin fine particles thus obtained to aggregate and fuse the resin fine particles (hereinafter, also referred to as the "aggregating and fusing step").

Hereinafter, respective steps (a) and (b) and respective steps (c) to (e), which are arbitrarily performed, other than the steps (a) and (b) will be described in detail.

(a) Dispersion Liquid Preparation Step

The step (a) includes a step of dispersing fine particles of the crystalline polyester resin and fine particles of the amorphous resin in a water-based medium, and as necessary, includes a colorant dispersion liquid preparation step, a releasing agent fine particle dispersion liquid preparation step, and the like.

The step of dispersing fine particles of the crystalline polyester resin and fine particles of the amorphous resin in a water-based medium is preferably performed in such a manner that the step of preparing a dispersion liquid of crystalline polyester resin fine particles and the step of preparing a dispersion liquid of amorphous resin fine particles are performed first, and then these dispersion liquids are mixed.

Hereinafter, the steps of preparing respective dispersion liquids will be described.

(a-1) Step of Preparing Dispersion Liquid of Crystalline Polyester Resin Fine Particles The step of preparing a dispersion liquid of crystalline polyester resin (hybrid resin) fine particles is a step of synthesizing a crystalline polyester resin constituting the toner particles and dispersing the crystalline polyester resin in the form of fine particles in a water-based medium to prepare the dispersion liquid of crystalline polyester resin fine particles.

The method for producing the crystalline polyester resin is as described above and thus detailed description thereof is omitted. However, in order for a toner to be obtained to satisfy the above Formulae (1) to (4), the composition and the mass ratio of the resin are preferably set as described in the preferred embodiment. In particular, in a case where a hybrid resin is used as the crystalline polyester resin, the content ratios of the crystalline polyester resin unit and the amorphous resin unit are preferably set as described in the preferred embodiment.

Regarding the dispersion liquid of crystalline polyester resin fine particles, for example, a method in which dispersion treatment is carried out in a water-based medium without using a solvent, or a method in which a crystalline polyester resin is dissolved in a solvent such as ethyl acetate to obtain a solution, the solution is subjected to emulsion dispersion in a water-based medium by using a dispersing machine, and then desolvation treatment is carried out is exemplified. Among them, from the viewpoint of simplification of processes, the former method is preferable.

The term "water-based medium" in the present invention refers to a medium containing water in an amount of at least 50% by mass or more. As components other than water, water-soluble organic solvents can be exemplified, and examples thereof include methanol, ethanol, isopropanol, butanol, acetone, methyl ethyl ketone, dimethylformamide, methyl cellosolve, and tetrahydrofuran. Among these, it is preferable to use alcoholic organic solvents, which do not dissolve a resin, such as methanol, ethanol, isopropanol, and butanol. Preferably, only water is used as the water-based medium.

The crystalline polyester resin contains a carboxyl group in some cases. Therefore, ammonia, sodium hydroxide, or the like may be added for the purpose that the carboxyl group is subjected to ionic dissociation and stably emulsified in a water phase so that the emulsification is allowed to smoothly proceed.

Further, a dispersion stabilizer may be dissolved in the water-based medium, and a surfactant, resin fine particles, or the like may also be added in order to improve dispersion stability of oil droplets.

As the dispersion stabilizer, known dispersion stabilizers can be used, and for example, an acid- or alkali-soluble dispersion stabilizer such as tricalcium phosphate is preferably used, or an enzyme-degradable dispersion stabilizer is preferably used in terms of environment concern.

As a surfactant, known anionic surfactants, cationic surfactants, nonionic surfactants, and amphoteric surfactants can be used.

Further, as resin fine particles for improving dispersion stability, methyl polymethacrylate resin fine particles, polystyrene resin fine particles, polystyrene acrylonitrile resin fine particles, and the like are exemplified.

Such dispersion treatment described above can be performed by employing mechanical energy. Dispersing machines are not particularly limited, and examples thereof include a homogenizer, a low-speed shearing dispersing machine, a high-speed shearing dispersing machine, a friction-type dispersing machine, a high-pressure jet dispersing machine, an ultrasonic dispersing machine, and a high-pressure impact dispersing machine Ultimizer.

The particle diameter of the crystalline polyester resin fine particles (oil droplets) in the dispersion liquid of crystalline polyester resin fine particles prepared in this way is set to preferably 60 to 1000 nm and more preferably 80 to 500 nm in terms of the volume-based median diameter. Incidentally, this volume average particle diameter is measured by the method described in Examples. Incidentally, the volume average particle diameter of the oil droplets can be controlled by the magnitude of mechanical energy at the time of emulsion dispersion.

Further, the content of the crystalline polyester resin fine particles in the dispersion liquid of crystalline polyester resin fine particles is set preferably in the range of 10 to 50% by mass and more preferably in the range of 15 to 40% by mass with respect to 100% by mass of the dispersion liquid. When the content thereof is in such a range, spreading of particle size distribution is suppressed and the toner properties can be improved.

(a-2) Step of Preparing Dispersion Liquid of Amorphous Resin Fine Particles

The step of preparing a dispersion liquid of amorphous resin fine particles is a step of synthesizing an amorphous resin constituting the toner particles and dispersing the amorphous resin in the form of fine particles in a water-based medium to prepare a dispersion liquid of amorphous resin fine particles.

Since the method for producing the amorphous resin is as described above, detailed description thereof is omitted.

Examples of a method of dispersing an amorphous resin in a water-based medium include a method (I) of forming amorphous resin fine particles from a monomer for obtaining an amorphous resin to prepare a water-based dispersion liquid of the amorphous resin fine particles and a method (II) of dissolving or dispersing an amorphous resin in an organic solvent (solvent) to prepare an oil phase liquid, dispersing the oil phase liquid in a water-based medium by phase inversion emulsification or the like to form oil droplets controlled to have a desired particle diameter, and then removing the organic solvent (solvent). Among them, from the viewpoint of process simplification, the method (I) is preferable. Therefore, hereinafter, the method (I) will be described.

In the relevant method, first, a monomer for obtaining an amorphous resin and a polymerization initiator are added into a water-based medium and polymerized to obtain basic particles. The water-based medium is as described in the step (a-1), and a surfactant such as sodium dodecyl sulfate or resin fine particles may be added into this water-based medium for the purpose of improving dispersion stability.

Next, it is preferable to use a method of adding a radically polymerizable monomer for obtaining an amorphous resin and a polymerization initiator into the dispersion liquid having the resin fine particles dispersed therein, and performing seed polymerization on the basic particles with the radically polymerizable monomer.

At this time, as the polymerization initiator, a water-soluble polymerization initiator can be used. As the water-soluble polymerization initiator, for example, a water-soluble radical polymerization initiator such as potassium persulfate or ammonium persulfate can be suitably used.

Further, a chain transfer agent, which is generally used, can be used for the purpose of adjusting the molecular weight of the amorphous resin in a seed polymerization reaction system for obtaining amorphous resin fine particles. As the chain transfer agent, it is possible to use mercaptan such as octylmercaptan, dodecylmercaptan, or t-dodecylmercaptan; mercaptopropionic acid such as n-octyl-3-mercaptopropionate or stearyl-3-mercaptopropionate; styrene dimmer; and the like. These can be used alone or in combination of two or more kinds thereof.

Incidentally, in the method (I), when amorphous resin fine particles are formed from the monomer for obtaining an amorphous resin, a releasing agent may be contained in the amorphous resin fine particles by dispersing the monomer and the releasing agent. Further, a dispersion liquid of the amorphous resin fine particles may be prepared by further performing the seed polymerization reaction, that is, by performing multiple-stage polymerization reaction.

Hereinbefore, the seed polymerization method has been described as an example. However, an emulsion polymerization method or a dispersion polymerization method may be employed depending on the type of the amorphous resin.

As described above, the toner according to present invention preferably includes the high-molecular-weight product in the amorphous resin. Accordingly, in the relevant step, it is preferable to further include a step of adjusting a dispersion liquid containing fine particles of the amorphous resin that contains the high-molecular-weight product, as the amorphous resin fine particles. The production method and conditions are not particularly limited, but known production method and conditions can be used without any change or can be used with appropriate modification. However, it is preferable to appropriately adjust the reaction temperature, the reaction concentration, the added amount of the aforementioned chain transfer agent, and the like such that the weight average molecular weight of the high-molecular-weight product contained in the resin fine particles to be obtained becomes a desired value.

The particle diameter of the amorphous resin fine particles (oil droplets) in the dispersion liquid of the amorphous resin fine particles prepared by the above-described method is set to preferably 60 to 1000 nm and more preferably 80 to 500 nm in terms of the volume-based median diameter. Incidentally, this volume average particle diameter is measured by the method described in Examples. Incidentally, the volume average particle diameter of the oil droplets can be controlled by the magnitude of mechanical energy at the time of emulsion dispersion.

Further, the content of the amorphous resin fine particles in the dispersion liquid of amorphous resin fine particles is set preferably in the range of 5 to 50% by mass and more preferably in the range of 10 to 40% by mass. When the content thereof is in such a range, spreading of particle size distribution is suppressed and the toner properties can be improved.

(a-3) Colorant Dispersion Liquid Preparation Step/Releasing Agent Fine Particle Dispersion Liquid Preparation Step The colorant dispersion liquid preparation step is a step of dispersing a colorant in the form of fine particles in a water-based medium to prepare a dispersion liquid of colorant fine particles. Further, the releasing agent fine particle dispersion liquid preparation step is a step which is performed as necessary in a case where toner particles containing a releasing agent is demanded and in which a releasing agent is dispersed in the form of fine particles in a water-based medium to prepare a dispersion liquid of releasing agent fine particles.

The water-based medium is as described in the step (a-1), and a surfactant or resin fine particles may be added into this water-based medium for the purpose of improving dispersion stability.

Dispersion of the colorant/releasing agent can be performed by using mechanical energy, and such a dispersing machine is not particularly limited, but dispersing machines described in the step (a-1) can be used.

The content of the colorant in the dispersion liquid of the colorant is set preferably in the range of 10 to 50% by mass and more preferably in the range of 15 to 40% by mass. When the content thereof is in such a range, an effect of ensuring color reproducibility is achieved. Further, the content of the releasing agent fine particles in the dispersion liquid of releasing agent fine particles is set preferably in the range of 10 to 50% by mass and more preferably in the range of 15 to 40% by mass. When the content thereof is in such a range, effects of preventing hot offset and ensuring separation properties are achieved.

(b) Aggregating and Fusing Step

This aggregating and fusing step is a step of aggregating the aforementioned crystalline polyester resin fine particles and amorphous resin fine particles, and as necessary, colorant particles and/or releasing agent fine particles in a water-based medium and fusing these particles at the same time of aggregating these particles to thereby obtain a binder resin.

In this step, a dispersion liquid is mixed such that the above Formulae (1) to (4) are satisfied. Herein, in order to satisfy the above Formulae (1) to (4), it is preferable to adjust the content ratios of the crystalline polyester resin and the amorphous resin in the binder resin and to adjust the amount of each dispersion liquid such that the amount is in the preferable range described above.

In this step, first, in order to obtain a binder resin satisfying the above Formulae (1) to (4), crystalline polyester resin fine particles and amorphous resin fine particles, and as necessary, colorant particles and/or releasing agent fine particles are mixed, and these particles are dispersed in a water-based medium. Herein, the amorphous resin fine particles preferably contain resin fine particles containing a high-molecular-weight product.

Subsequently, an alkali metal salt or a salt containing the Group 2 elements is added as an aggregating agent, aggregating is allowed to proceed by heating at a temperature equal to or higher than the glass transition temperature of crystalline polyester resin fine particles and amorphous resin fine particles, and the resin particles are fused to each other at the same time.

Specifically, the dispersion liquid of the crystalline polyester resin and the dispersion liquid of the amorphous resin, which are prepared in the aforementioned procedures, and as necessary, a dispersion liquid of colorant particles and/or a dispersion liquid of releasing agent fine particles are mixed, and the particles are fused to each other at the same time when crystalline polyester resin fine particles and amorphous resin fine particles, and as necessary, colorant particles and/or releasing agent fine particles are aggregated by adding an aggregating agent such as magnesium chloride, thereby forming a binder resin. Then, the aggregating is stopped by adding a salt such as saline solution when the size of the aggregated particles reaches a target size.

The aggregating agent used in this step is not particularly limited, but an aggregating agent selected from metal salts is preferably used. The aggregating agent can be used alone or in combination of two or more kinds thereof.

In the aggregating step, it is important to continue fusing by maintaining a temperature of the dispersion liquid for aggregating for a certain time, preferably, until the volume-based median diameter reaches 4.5 to 7.0 μm. Further, the average circularity of particles during aging is measured, and it is preferable to perform a first aging step until the average circularity reaches preferably 0.920 to 1.000.

According to this, the growth of particles (aggregating of crystalline polyester resin fine particles and amorphous resin fine particles, and as necessary, colorant particles/releasing agent fine particles) and fusing (loss of an interface between particles) can be allowed to effectively proceed, and durability of toner particles to be finally obtained can be improved.

(c) Cooling Step

This cooling step is a step of performing cooling treatment on the dispersion liquid of the toner particles. A cooling rate in the cooling treatment is not particularly limited, but is preferably 0.2 to 20° C./min. The cooling treatment method is not particularly limited, and examples thereof may include a method in which a cooling medium is introduced from the outside of a reaction vessel to perform cooling and a method in which cooling water is directly fed to the reaction system to perform cooling.

(d) Filtering, Washing, and Drying Steps

In the filtering step, toner particles are separated by filtration from the dispersion liquid of toner particles. Examples of a filtration treatment method include a centrifugal separation method, a filtration method under reduced pressure by using Buchner's funnel, and a filtration method using a filter press or the like, and the filtration treatment method is not particularly limited.

Next, adhered materials such as a surfactant and an aggregating agent are removed from the toner particles separated by filtration (cake-like aggregate) by performing washing in the washing step. The washing treatment is performed with water until electrical conductivity of the filtrate reaches, for example, a level of 5 to 20 μS/cm.

In the drying step, drying treatment is performed on the washed toner particles. Examples of a dryer used in this drying step include known dryers such as a spray dryer, a vacuum freeze-dryer, and a reduced pressure dryer, and it is also possible to use a standing plate dryer, a mobile plate dryer, a fluidized-bed dryer, a rotary dryer, a stirring dryer, or the like. The moisture content contained in the dried toner particles is preferably 5% by mass or less and more preferably 2% by mass or less.

Further, in a case where dried toner particles are aggregated by a weak inter-particle attractive force, the aggregate may be subjected to pulverization treatment. As a pulverization treatment apparatus, a mechanical pulverization apparatus such as a jet mill, a Henschel mixer, a coffee mill, or a food processor can be used.

(e) External Additive Treatment Step

This step is a step of adding and mixing an external additive to the surface of the dried toner particles as necessary to prepare a toner. With addition of the external additive, flowability and electrification of the toner are improved, and improvement in cleaning properties or the like is realized.

<Developer>

Regarding the toner as described above, for example, a case where a magnetic body is contained in the toner so as to be used as a single-component magnetic toner, a case where a so-called carrier is mixed with the toner so as to be used as a two-component developer, and a case where a non-magnetic toner is used alone are considered, and any of cases can be preferably used.

As a carrier constituting the two-component developer, magnetic particles formed by a conventionally known material such as metal (such as iron, ferrite, or magnetite) or an alloy of aluminum or lead with these metals can be used, and ferrite particles are particularly preferably used.

As a carrier, a carrier having a volume average particle diameter of 15 to 100 μm is preferable and a carrier having a volume average particle diameter of 25 to 60 μm is more preferable.

As a carrier, a carrier further covered with a resin or a carrier obtained by dispersing magnetic particles (a so-called resin dispersion type carrier) is preferably used. The composition of a coating resin is not particularly limited, but for example, an olefin resin, a cyclohexyl methacrylate-methyl methacrylate copolymer, a styrene resin, a styrene-acrylic resin, a silicone resin, an ester resin, a fluororesin, or the like is used. Further, a resin for constituting the resin dispersion type carrier is not particularly limited, and a known resin can be used. For example, an acrylic resin, a styrene-acrylic resin, a polyester resin, a fluororesin, a phenolic resin, or the like can be used.

<Fixing Method>

As a suitable fixing method using the toner of the present invention, a so-called contact heating system can be exemplified. As the contact heating system, particularly, a thermo-pressure fixing system, a heat roll fixing system, and a pressure heat-fixing system in which fixing is performed by a fixed rotatable pressure member enclosing a heating body can be exemplified.

Hereinbefore, the embodiments of the present invention have been described. However, the present invention is not limited to the embodiments described above, and various modifications can be added thereto.

EXAMPLES

Hereinafter, the present invention will be described in more detail by describing representative embodiments of the present invention. However, the present invention is not limited to these embodiments. Incidentally, "part(s)" represents "part(s) by mass" and "%" represents "% by mass" in Examples unless otherwise specified.

<Analysis and Measurement Methods>

(Temperature of Endothermic Peak Derived from Crystalline Polyester Resin (Tm1) and Endothermic Quantities (ΔH1, ΔH2))

The temperature of the endothermic peak (Tm1) and the endothermic quantities (ΔH1, ΔH2) were obtained by performing differential scanning calorimetry of the toner. The differential scanning calorimetry was carried out using a differential scanning calorimeter "Diamond DSC" (manufactured by PerkinElmer Inc.). A DSC curve was obtained by differential scanning calorimetry according to ASTM D3418-8. DSC measurement was carried out under measurement conditions (temperature increasing and cooling conditions) of undergoing a first heating process of increasing a temperature from room temperature (25° C.) to 150° C. at an increasing rate of 10° C./min and isothermally holding the temperature at 150° C. for 5 minutes, a cooling process of decreasing the temperature from 150° C. to room temperature at a cooling rate of 10° C./min and isothermally holding the temperature at room temperature for 5 minutes, and a second heating process of increasing the temperature from room temperature to 150° C. at an increasing rate of 10° C./min in this order. The measurement was performed in such a manner that 3.0 mg of the toner was encapsulated in an aluminum pan and the aluminum pan was set to a sample holder of the differential scanning calorimeter "Diamond DSC." An empty aluminum pan was used as a reference.

In the measurement, the endothermic quantity based on the melting peak (endothermic peak having a half-value width of 15° C. or lower) derived from the crystalline polyester resin in the first heating process was defined as ΔH1 (J/g), and the endothermic quantity based on the melting peak derived from the crystalline polyester resin in the second heating process was defined as ΔH2 (J/g). In addition, in the measurement, analysis was conducted from the endothermic curve obtained in the first heating process and the top temperature of the endothermic peak (endothermic peak having a half-value width of 15° C. or lower) derived from the crystalline polyester resin was defined as Tm1 (° C.). The results thereof are presented in the following Table 3.

(Melting Point (Tc) and Glass Transition Temperature (Tg1) of Each Resin)

The melting point and the glass transition temperature of each resin constituting the toner were obtained by performing differential scanning calorimetry on each resin. The same differential scanning calorimetry as described above was used. The measurement was performed under the same conditions (temperature increasing and cooling conditions). The measurement was performed in such a manner that 3.0 mg of each resin was encapsulated in an aluminum pan and the aluminum pan was set to a sample holder of the differential scanning calorimeter "Diamond DSC." An empty aluminum pan was used as a reference.

In the measurement, the top temperature of the melting peak (endothermic peak having a half-value width of 15° C. or lower) of the resin in the first heating process was defined as the melting point (Tc) of the resin. In addition, regarding the glass transition temperature (Tg1) of the amorphous resin, the DSC curve was measured by differential scanning calorimetry according to ASTM D3418-8. The measurement was performed in the same manner as described above, except that an increasing rate was changed from 10° C./min to 20° C./min, and the offset temperature obtained by the endothermic curve obtained in the first heating process was defined as the glass transition temperature Tg1 (° C.).

(Softening Temperature ($T_{fl/2}$))

1 $cm^3$ of the sample was melted and flowed under the conditions of a pore size of dies of 0.5 mm, a pressurization load of 0.98 MPa (10 $kg/cm^2$), and a temperature increasing rate of 1° C./min by using an elevated flow tester CFT-500D (manufactured by Shimadzu Corporation). The temperature corresponding to ½ of the height from the flow start point to the endpoint at this time was obtained as $T_{fl/2}$. The results thereof are presented in Table 3. Incidentally, in Table 3, a case where $T_{fl/2}$ satisfies the relationship represented by Formula (2) was described as "○," and a case where $T_{fl/2}$ does not satisfy the relationship represented by Formula (2) was described as "x."

(Weight Average Molecular Weight of Resin Included in THF Soluble Content of Toner)

First, 10 mg of the toner was put into 10 mL of THF (tetrahydrofuran) and stirred for 30 minutes under the condition of 25° C. to obtain a dissolution liquid in which the soluble content was dissolved. The solution was filtered using a membrane filter having an opening of 0.2 μm to obtain a THF soluble content of the toner.

Subsequently, the THF soluble content of the toner obtained by the above-described procedures was used as a sample for GPC measurement and analysis was performed by GPC under the following conditions. When the entire surface integration of an elution curve in GPC obtained by this analysis was defined as W and an eluted content corresponding to a flow-out content of 90% to 100% of W with time was defined as F(90-100), the weight average molecular weight of the resin included in the eluted content F(90-100) was calculated. Further, the weight average molecular weight of the entire surface integration (entire eluted content) was measured and the measured weight average molecular weight was defined as the "weight average molecular weight of the resin included in the THF soluble content of the toner" (the item "Mw" in Table 3). The results thereof are presented in the following Table 3.

—GPC Analysis Conditions—

"HLC-8120GPC, SC-8020 (manufactured by Tosoh Corporation)" was used as a GPC apparatus, two columns of "TSKgel, SuperHM-H (manufactured by Tosoh Corporation, 6.0 mmID×15 cm)" was used as columns, and THF was used as an eluent. Analysis was carried out at a flow rate of 0.6 mL/min, a sample injection amount of 10 μL, and a measurement temperature of 40° C. by using an RI detector. In addition, a calibration curve was prepared from 10 samples of "polystyrene standard sample TSK standard" manufactured by Tosoh Corporation: "A-500," "F-1," "F-10," "F-80," "F-380," "A-2500," "F-4," "F-40," "F-128, and "F-700." Incidentally, data collecting interval in the sample analysis was set to 300 ms.

(Measurement of Weight Average Molecular Weight (Mw) and Number Average Molecular Weight (Mn))

A resin to be measured was dissolved in THF such that the concentration thereof reached 1 mg/mL, and then was filtered with a membrane filter having a pore size of 0.2 μm, and the obtained solution was used as a sample for GPC measurement. As GPC measurement conditions, the same conditions as the conditions described in the section (Weight Average Molecular Weight of Resin Included in THF Soluble Content of Toner) were employed, and the weight average molecular weight of the resin included in the sample was measured.

(Average Particle Diameter of Resin Particles, Colorant Particles, or the Like)

The volume average particle diameter (volume-based median diameter) of the resin particles, colorant particles, or the like was measured by "UPA-150" (manufactured by MicrotracBEL Corp.).

<Production of Water-Based Dispersion Liquid of Crystalline Polyester Resin Fine Particles>

Synthesis Example 1

Synthesis of Crystalline Polyester Resin (CPES-1)

A raw material monomer of an addition polymerization resin (styrene-acrylic resin: StAc) unit to be described below including a dually reactive monomer and a radical polymerization initiator were put in a dropping funnel.

| | |
|---|---|
| Styrene (ST) | 55 parts by mass |
| n-Butyl acrylate (BA) | 14 parts by mass |
| Acrylic acid (AA) | 6 parts by mass |
| Polymerization initiator (di-t-butyl peroxide) | 11 parts by mass |

Further, a raw material monomer of a polycondensation resin (crystalline polyester resin: CPEs) unit to be described below was put into a four-neck flask equipped with a nitrogen inlet tube, a dehydration tube, a stirrer, and a thermocouple, and was heated to 170° C. so as to be dissolved.

| | |
|---|---|
| Sebacic acid | 302 parts by mass |
| 1,12-Dodecanediol | 123 parts by mass |

Subsequently, the raw material monomer of the addition polymerization resin (StAc) was added dropwise over 90 minutes under stirring and aged for 60 minutes, and then the unreacted addition polymerization monomer was removed under reduced pressure (8 kPa). Incidentally, the amount of the monomer removed at this time was a very minute amount with respect to the amount of the raw material monomer of the resin.

Thereafter, 0.8 part by mass of $Ti(OBu)_4$ as an esterification catalyst was put thereinto and heated to 235° C., and reaction was performed for 5 hours under normal pressure (101.3 kPa) and for 1 hour under reduced pressure (8 kPa).

Next, the resultant solution was cooled to 200° C., and reaction was performed for 1 hour under reduced pressure (20 kPa) to thereby obtain a crystalline polyester resin (CPES-1). The crystalline polyester resin (CPES-1) contained 15% by mass of the resin (StAc) unit other than CPEs with respect to the total amount of the crystalline polyester resin (CPES-1), and was a resin having a form in which CPEs was grafted to StAc. In addition, the number average molecular weight (Mn) of the crystalline polyester resin (CPES-1) was 5,000, the weight average molecular weight (Mw) was 16,000, and the melting point (Tc) was 65° C.

Synthesis Examples 2 to 6

Synthesis of Crystalline Polyester Resins (CPES-2) to (CPES-6)

Crystalline polyester resins (CPES-2), (CPES-3), (CPES-5), and (CPES-6) were obtained in the same manner as in Synthesis Example 1 described above, except that the used amount of the raw material monomer of the addition polymerization resin (StAc) unit and the used amount of the raw material monomer of the polycondensation resin (CPEs) unit in the crystalline polyester resin were changed as presented in the following Table 1. These crystalline polyester resins were also a resin having a form in which CPEs was grafted to StAc.

Incidentally, regarding a crystalline polyester resin (CPES-4), the raw material monomer of the addition polymerization resin (StAc) unit was not used, and only esterification reaction of the raw material monomer of the polycondensation resin (crystalline polyester resin: CPEs) unit was performed under the same condition as in Synthesis Example 1 described above.

Synthesis Example 7

Synthesis of Crystalline Polyester Resin (CPES-7)

A crystalline polyester resin (CPES-7) was obtained by mixing respective components to be described below in a flask, heating to 220° C. under reduced pressure atmosphere, and performing dehydrating condensation reaction for 6 hours.

| | |
|---|---|
| Succinic acid | 679.4 parts by mass |
| Fumaric acid (FA) | 40.6 parts by mass |
| 1,4-Butanediol | 550.5 parts by mass |
| Dibutyltin | 2.0 parts by mass |

Synthesis Example 8

Synthesis of Crystalline Polyester Resin (CPES-8)

A crystalline polyester resin (CPES-8) was obtained in the same manner as in Synthesis Example 7 described above, except that the type and amount of the monomer used was changed as described below.

| | |
|---|---|
| Sebacic acid | 900.2 parts by mass |
| Sodium 5-sulfoisophthalic acid | 26.6 parts by mass |
| Fumaric acid | 40.6 parts by mass |
| Ethylene glycol | 450.5 parts by mass |
| Dibutyltin | 2.0 parts by mass |

The number average molecular weight (Mn), the weight average molecular weight (Mw), and the melting point (Tc) of each of the crystalline polyester resins (CPES-2) to (CPES-8) are presented in Table 1. Incidentally, in Table 1, regarding the item "Form of resin," a case where the crystalline polyester resin is the aforementioned hybrid resin is described as "HB," and a case where the crystalline polyester resin is not the hybrid resin is described as "non-HB."

TABLE 1

| | | Crystalline polyester resin unit | | | | Vinyl resin unit | | | Composition | | | | |
|---|---|---|---|---|---|---|---|---|---|---|---|---|---|
| Type | Form of resin | Alcohol monomer | Added amount (part by mass) | Carboxylic acid monomer | Added amount (part by mass) | ST (part by mass) | BA (part by mass) | AA (part by mass) | CPES unit (% by mass) | Vinyl resin unit (% by mass) | Physical property value Mn | Mw | Tc (° C.) |
| CPES-1 | HB | 1,4-Butanediol | 123 | Sebacic acid | 302 | 55 | 14 | 6 | 85.0 | 15.0 | 5,000 | 16,000 | 65 |
| CPES-2 | HB | 1,4-Butanediol | 123 | Dodecanedioic acid | 344 | 55 | 14 | 6 | 86.2 | 13.8 | 6,500 | 18,000 | 68 |
| CPES-3 | HB | 1,4-Butanediol | 123 | Tetradeca-nedioic acid | 386 | 55 | 14 | 6 | 87.2 | 12.8 | 7,200 | 17,000 | 74 |
| CPES-4 | non-HB | 1,4-Butanediol | 123 | Dodecanedioic acid | 344 | 0 | 0 | 0 | 100 | 0 | 8,000 | 14,000 | 75 |
| CPES-5 | HB | 1,12-Dodeca-nediol | 276 | Dodecanedioic acid | 344 | 55 | 14 | 6 | 89.2 | 10.8 | 7,800 | 19,000 | 76 |
| CPES-6 | HB | 1,6-Hexanediol | 161 | Sebacic acid | 302 | 55 | 14 | 6 | 86.1 | 13.9 | 7,500 | 23,000 | 60 |
| CPES-7 | non-HB | 1,4-Butanediol | 550.5 | Succinic acid/ fumaric acid | 720 (*2) | 0 | 0 | 0 | 100 | 0 | 9,000 | 15,000 | 95 |
| CPES-8 | non-HB | Ethylene glycol | 450.5 | (*1) | 967.4 (*2) | 0 | 0 | 0 | 100 | 0 | 10,000 | 17,000 | 70 |

(*1): Sebacic acid/sodium 5-sulfoisophthalic acid/fumaric acid (*2): Total amount of carboxylic acid monomer Production Example 1

Preparation of Water-Based Dispersion Liquid (Z1) of Crystalline Polyester Resin Fine Particles 30 parts by mass of the crystalline polyester resin (CPES-1) obtained in Synthesis Example 1 described above was melted and the crystalline polyester resin (CPES-1) in the molten state was transferred to an emulsifying disperser "CAVITRON CD1010" (manufactured by EUROTEC Co., Ltd.) at a transfer rate of 100 parts by mass per minute. Further, at the same time as the transfer of the crystalline polyester resin (CPES-1) in the molten state, diluted ammonia water having a concentration of 0.37% by mass (the diluted ammonia water obtained by diluting 70 parts by mass of an ammonia water reagent with ion-exchange water in an aqueous solvent tank) was transferred to the emulsifying disperser at a transfer rate of 0.1 L per minute while the diluted ammonia water was heated to 100° C. in a heat exchanger. Then, this emulsifying disperser was operated under the conditions of a rotor rotation speed of 60 Hz and a pressure of 5 kg/cm$^2$ to thereby prepare a water-based dispersion liquid (Z1) of crystalline polyester resin fine particles having a volume-based median diameter of 200 nm and a solid content of 30 parts by mass.

Production Examples 2 to 8

Preparation of Water-Based Dispersion Liquids (Z2) to (Z8) of Crystalline Polyester Resin Fine Particles Each of water-based dispersion liquids (Z2) to (Z8) of crystalline polyester resin fine particles was prepared in the same manner as in Production Example 1 described above, except that the crystalline polyester resins (CPES-2) to (CPES-8) were respectively used instead of the crystalline polyester resin (CPES-1). At this time, the volume-based median diameter of particles included in the dispersion liquids (Z2) to (Z8) was within the range of 180 to 240 nm.

<Production of Water-Based Dispersion Liquid of Amorphous Resin Fine Particles>

Production Example 9

Preparation of Water-Based Dispersion Liquid (X1) of Amorphous Resin Fine Particles <<First Polymerization>>

A reaction vessel equipped with a stirring device, a temperature sensor, a cooling tube, and a nitrogen inlet device was charged with a solution obtained by dissolving 8 parts by mass of sodium dodecyl sulfate in 3000 parts by mass of ion-exchange water, and the internal temperature was increased to 80° C. under stirring with a stirring speed of 230 rpm under nitrogen flow. After increasing of the temperature, a solution obtained by dissolving 10 parts by mass of potassium persulfate in 200 parts by mass of ion-exchange water was added thereto, the liquid temperature was increased to 80° C. again, and a monomer mixed liquid composed of:

480 parts by mass of styrene (ST);

250 parts by mass of n-butyl acrylate (BA); and 68 parts by mass of methacrylic acid (MAA) was added dropwise over 1 hour. Thereafter, heating and stirring were performed at 80° C. for 2 hours so as to perform polymerization, thereby obtaining a dispersion liquid (x1) of resin fine particles.

<<Second Polymerization>>

A reaction vessel equipped with a stirring device, a temperature sensor, a cooling tube, and a nitrogen inlet device was charged with a solution obtained by dissolving 7 parts by mass of polyoxyethylene (2) sodium dodecylethersulfate in 800 parts by mass of ion-exchange water and heated to 98° C. Thereafter, a solution obtained by dissolving 260 parts by mass of the dispersion liquid (x1) of resin fine particles, 284 parts by mass of styrene (ST), 92 parts by mass of n-butyl acrylate (BA), 13 parts by mass of methacrylic acid (MAA), 1.5 parts by mass of n-octyl-3-mercaptopropionate, and 190 parts by mass of behenyl behenate (melting point 73° C.) as a releasing agent at 90° C. was added, followed by mixing dispersion treatment for 1 hour by using a mechanical dispersing machine having a circulation path "CLEARMIX" (manufactured by M Technique Co., Ltd.) to thereby prepare a dispersion liquid containing emulsified particles (oil droplets).

Subsequently, an initiator solution obtained by dissolving 6 parts by mass of potassium persulfate in 400 parts by mass of ion-exchange water was added to this dispersion liquid, and polymerization was performed by heating this system at 84° C. for 1 hour under stirring, thereby preparing a dispersion liquid (x2) of resin fine particles.

<<Third Polymerization>>

A solution obtained by dissolving 11 parts by mass of potassium persulfate in 400 parts by mass of ion-exchange water was added to the dispersion liquid (x2) of resin fine particles, and a mixed liquid of a monomer mixed liquid composed of:

400 parts by mass of styrene (ST);

128 parts by mass of n-butyl acrylate (BA);

28 parts by mass of methacrylic acid (MAA); and 45 parts by mass of methyl methacrylate (MMA) and 8 parts by mass of n-octyl-3-mercaptopropionate was added dropwise over 1 hour under the temperature condition of 82° C. After dropwise addition, polymerization was performed by heating and stirring over 2 hours, and then the resultant solution was cooled to 28° C., thereby preparing a water-based dispersion liquid (X1) of amorphous resin particles composed of a styrene acrylic copolymer.

Regarding the obtained water-based dispersion liquid (X1) of amorphous resin fine particles, the volume-based median diameter of amorphous resin fine particles was 220 nm, the glass transition temperature (Tg1) was 50° C., and the weight average molecular weight (Mw) was 25,000.

Synthesis Example 9

Synthesis of Amorphous Resin (APES-1)

A round-bottomed flask equipped with a stirring device, a nitrogen inlet tube, a temperature sensor, and a rectification column was charged with a polyvalent alcohol component and a polyvalent carboxylic acid component in the following composition, and the resultant mixture was heated to 200° C. by using a mantle heater. Then, the mixture was stirred while the flask was kept under an inert gas atmosphere by supplying a nitrogen gas from a gas supplying tube. Thereafter, 0.05 part by mass of dibutyltin oxide was added to 100 parts by mass of the raw material mixture, and the resultant mixture was allowed to react for a predetermined time while keeping the temperature of the reaction product at 200° C., thereby obtaining an amorphous polyester resin (APES-1).

| | |
|---|---|
| Adduct of 1 mole of ethylene oxide to bisphenol A | 30 parts by mass |
| Ethylene glycol | 20 parts by mass |
| Terephthalic acid | 35 parts by mass |
| Succinic acid | 15 parts by mass |

Regarding the obtained amorphous resin fine particles (APES-1), the glass transition temperature (Tg1) was 58° C. and the weight average molecular weight (Mw) was 9,500.

Synthesis Example 10

Synthesis of Amorphous Resin (APES-2)

An amorphous polyester resin (APES-2) was obtained in the same manner as described above, except that the used raw materials were changed as described below in the synthesis of APES-1 described above.

| | |
|---|---|
| Adduct of 1 mole of ethylene oxide to bisphenol A | 25 parts by mass |
| Adduct of 1 mole of propylene oxide to bisphenol A | 25 parts by mass |
| Terephthalic acid | 30 parts by mass |
| Succinic acid | 5 parts by mass |
| Anhydrous trimellitic acid | 15 parts by mass |

Regarding the obtained amorphous resin fine particles (APES-2), the glass transition temperature (Tg1) was 64° C. and the weight average molecular weight (Mw) was 42,000.

Production Example 10

Preparation of Water-Based Dispersion Liquid (X2) of Amorphous Resin Fine Particles The amorphous polyester resin (APES-1) obtained in Synthesis Example 9 described above was melted and the amorphous polyester resin (APES-1) in the molten state was transferred to an emulsifying disperser "CAVITRON CD1010" (manufactured by EUROTEC Co., Ltd.) at a transfer rate of 100 parts by mass per minute. Further, at the same time as the transfer of the amorphous polyester resin (APES-1) in the molten state, diluted ammonia water having a concentration of 0.40% by mass (the diluted ammonia water obtained by diluting an ammonia water reagent with ion-exchange water in an aqueous solvent tank) was transferred to the emulsifying disperser at a transfer rate of 0.1 L per minute while the diluted ammonia water was heated to 120° C. in a heat exchanger. Then, this emulsifying disperser was operated under the conditions of a rotor rotation speed of 60 Hz and a pressure of 0.49 MPa (5 kg/cm$^2$) to thereby prepare a water-based dispersion liquid (X2) of amorphous polyester resin fine particles having a volume-based median diameter of 180 nm and a solid content of 30 parts by mass. In addition, the weight average molecular weight (Mw) of the obtained amorphous resin was 9,800.

Production Example 11

Preparation of Water-Based Dispersion Liquid (X3) of Amorphous Resin Fine Particles A water-based dispersion liquid (X3) of amorphous resin fine particles was prepared in the same manner as described above, except that the amorphous polyester resin obtained in Synthesis Example 10 was changed to (APES-2) in the preparation of the water-based dispersion liquid (X2) of amorphous resin fine particles. In the obtained water-based dispersion liquid (X3) of amorphous resin fine particles, the volume-based median diameter of the resin fine particles was 230 nm and the solid content was 30 parts by mass. In addition, the weight average molecular weight (Mw) of the obtained amorphous resin was 44,000.

<Production of Water-Based Dispersion Liquid of High-Molecular-Weight Resin Fine Particles>

Production Example 12

Preparation of Water-Based Dispersion Liquid (Y1) of High-Molecular-Weight Resin Fine Particles (a)

A 5 L reaction vessel equipped with a stirring device, a temperature sensor, a cooling tube, and a nitrogen inlet device was charged with a solution obtained by dissolving 8 parts by mass of sodium dodecyl sulfate in 3000 parts by mass of ion-exchange water, and the internal temperature was increased to 80° C. under stirring with a stirring speed of 230 rpm under nitrogen flow. After increasing of the temperature, a solution obtained by dissolving 10 parts by mass of potassium persulfate in 200 parts by mass of ion-exchange water was added thereto, the liquid temperature was increased to 80° C. again, and a monomer mixed liquid to be described below was added dropwise over 1 hour. Thereafter, heating and stirring were performed at 80° C. for 2 hours so as to perform polymerization, thereby preparing a water-based dispersion liquid (Y1) of resin fine particles. The average particle diameter of the resin fine particles in this water-based dispersion liquid (Y1) of resin fine particles was 90 nm in terms of the volume-based median diameter and the weight average molecular weight (Mw) was 400,000.

| | |
|---|---|
| Itaconic acid | 48 parts by mass |
| n-Butyl acrylate | 192 parts by mass |
| Methyl methacrylate | 360 parts by mass |
| n-Octyl-3-mercaptopropionate | 0.35 part by mass |

Production Example 13

Preparation of Water-Based Dispersion Liquid (Y2) of High-Molecular-Weight Resin Fine Particles (b)

A water-based dispersion liquid (Y2) of high-molecular-weight resin fine particles was prepared in the same manner as described above, except that 0.7 part by mass of n-octyl-3-mercaptopropionate was added in the preparation of the water-based dispersion liquid (Y1) of high-molecular-weight resin fine particles (a). The average particle diameter of the resin fine particles in this water-based dispersion liquid (Y2) of high-molecular-weight resin fine particles was 95 nm in terms of volume-based median diameter and the weight average molecular weight (Mw) was 200,000.

Production Example 14

Preparation of Water-Based Dispersion Liquid (Y3) of High-Molecular-Weight Resin Fine Particles (c)

A water-based dispersion liquid (Y3) of high-molecular-weight resin fine particles was prepared in the same manner as described above, except that the added amount of n-octyl-3-mercaptopropionate was changed to 0.05 part by mass in the preparation of the water-based dispersion liquid (Y1) of high-molecular-weight resin fine particles (a). The average particle diameter of the resin fine particles in the water-based dispersion liquid (Y3) of high-molecular-weight resin fine particles was 100 nm in terms of the volume-based median diameter, and the weight average molecular weight (Mw) was 1,100,000.

<Production of Water-Based Dispersion Liquid (Bk) of Colorant Fine Particles>

Production Example 15

Preparation of Water-Based Dispersion Liquid (Bk) of Colorant Fine Particles 90 parts by mass of sodium dodecyl sulfate was dissolved in 1600 parts by mass of ion-exchange water under stirring and 420 parts by mass of carbon black (furnace black) "REGAL 330R" (manufactured by Cabot Corporation) was gradually added thereto while the solution was stirred. Then, the resultant mixture was subjected to dispersion treatment using a stirring device "CLEARMIX" (manufactured by M Technique Co., Ltd.) to thereby prepare a dispersion liquid (Bk) of colorant fine particles in which colorant fine particles (Bk) were dispersed. The volume-based median diameter of the colorant fine particles (Bk) in the dispersion liquid (Bk) of colorant fine particles was 120 nm.

<Production of Toner>

Example 1

Production of Black Toner (1)

A reaction vessel equipped with a stirring device, a temperature sensor, a cooling tube, and a nitrogen inlet device was charged with the water-based dispersion liquid (X1) in which 400 parts by mass (in terms of solid content) of amorphous resin fine particles were dispersed, the water-based dispersion liquid (Y1) in which 25 parts by mass (in terms of solid content) of high-molecular-weight resin fine particles were dispersed, the water-based dispersion liquid (Z1) in which 75 parts by mass (in terms of solid content) of crystalline polyester resin fine particles were dispersed, 2500 parts by mass of ion-exchange water, and 500 parts by mass of the water-based dispersion liquid (Bk) of colorant fine particles (99.5 parts by mass in terms of solid content of colorant fine particles). After the temperature of the solution was adjusted to 25° C., an aqueous sodium hydroxide solution having a concentration of 25% by mass was added to adjust the pH to 10.

Subsequently, an aqueous solution obtained by dissolving 54.3 parts by mass of magnesium chloride hexahydrate in 54.3 parts by mass of ion-exchange water was added, and then aggregation reaction between respective resin fine particles and colorant fine particles was started by increasing the temperature of the system to 97° C.

After the starting of this aggregation reaction, sampling was carried out periodically, the volume-based median diameter of the colored particles was measured by using a particle size distribution measurement apparatus "COULTER MULTISIZER 3" (manufactured by Beckmann Coulter), and then the particles were aggregated while stirring was continued until the volume-based median diameter reached 6.3 μm.

Next, an aqueous solution obtained by dissolving 11.5 parts by mass of sodium chloride in 46 parts by mass of ion-exchange water was added, the temperature of the system was adjusted to 95° C., stirring was continued for 4 hours, and the reaction was stopped by cooling the solution to 30° C. under the condition of 6° C./min at the time point when the circularity measured by a flow-type particle image analyzer "FPIA-2100" (manufactured by Sysmex Corporation) reached 0.946, thereby obtaining a dispersion liquid of toner particles. The particle diameter of the toner particles after cooling was 6.1 μm and the circularity was 0.946.

The dispersion liquid of toner particles obtained in this way was subjected to solid-liquid separation using a basket-type centrifuge "MARK III TYPE 60×40 (manufactured by Matsumoto Machine Co., Ltd.) to form a wet cake. This wet cake was repeatedly subjected to washing and solid-liquid separation in the basket-type centrifuge until the electrical conductivity of the filtrate reached 15 μS/cm. Thereafter, the wet cake was subjected to drying treatment by blowing an air flow having a temperature of 40° C. and a humidity of 20% RH using "Flash Jet Dryer" (manufactured by SEISHIN ENTERPRISE Co., Ltd.) until the moisture content became 0.5% by mass, and the wet cake was cooled to 24° C., thereby obtaining toner particles (1).

To the obtained toner particles (1), 1% by mass of hydrophobic silica particles and 1.2% by mass of hydrophobic titanium oxide were added, and these particles were mixed using a Henschel mixer for 20 minutes under the condition of a peripheral speed of a rotary blade of 24 m/s and were caused to pass through a 400 mesh sieve to thereby add an external additive, whereby a black toner (1) was obtained. The weight average molecular weight of the THF soluble content of the obtained black toner (1) was 32,000. Further, the weight average molecular weight of the resin included in F(90-100) was 400,000.

Incidentally, although the external additive was added to the black toner (1), the shape and the particle diameter of the toner particles were not changed.

Examples 2 to 12

Production of Black Toners (2) to (12)

Each of black toners (2) to (12) was produced in the same manner as in Example 1, except that the type and the added amount of each dispersion liquid were changed such that the type and the added amount (in terms of solid content) of each of the crystalline polyester resin, the amorphous resin, and the high-molecular-weight resin in the binder resin were changed to values in Table 2. The volume average particle diameter of each of the black toners (2) to (12) was within the range of 6.1 to 6.4 μm. The weight average molecular weight of the resin included in the THF soluble content and the weight average molecular weight of the resin included in F(90-100) of each of the black toners (2) to (12) are presented in Table 3.

Comparative Examples 1 to 4

Production of Black Toners (13) to (16)

Each of black toners (13) to (16) was produced in the same manner as in Example 1, except that the type and the added amount of each dispersion liquid were changed such that the type and the added amount (in terms of solid content) of each of the crystalline polyester resin, the amorphous resin, and the high-molecular-weight resin in the binder resin were changed to values in Table 2. The volume average particle diameter of each of the black toners (13) to (16) was within the range of 6.0 to 6.5 μm. The weight average molecular weight of the resin included in the THF soluble content and the weight average molecular weight of the resin included in F(90-100) of each of the black toners (13) to (16) are presented in Table 3.

<Preparation of Developer>

Each of developers (1) to (16) was produced by adding a ferrite carrier having a volume average particle diameter of 40 μm and coated with a silicone resin to each of the black toners (1) to (16) produced in Examples and Comparative Examples described above and then mixing them such that the concentration of the toner particles became 6% by mass.

<Evaluation>

(Low Temperature Fixability Evaluation)

The low temperature fixability was evaluated by using an apparatus that was modified such that the surface temperature of a fixing heat roller could be changed in the range of 100 to 180° C. at an interval of 5° C. in a commercially available multi-functional full-color printer "bizhub PRO C6501" (manufactured by KONICA MINOLTA, INC.).

Each of the developers (1) to (16) to be evaluated was installed in the apparatus, and a sheet having a basis weight of 350 g was used as an image supporting body and developed at each temperature at a toner adhesion amount of 11 g/m$^2$ under the normal temperature environment (temperature: 20° C., humidity: 50% RH). The surface temperature of the fixing roller was changed from 100 to 180° C. at an interval 5° C. under the same environment so as to respectively perform fixing. Thereafter, the obtained solid fixed image was folded with a folding machine. Air at 0.35 MPa was blown thereto and the state of the fold line portion was compared with a limit sample, and evaluation was carried out at five ranks. The fixing temperature of Rank 3 was designated as a fixing lower limit temperature. As this fixing lower limit temperature decreases, low temperature fixability is excellent. The evaluation on the fixing lower limit temperature was carried out according to the following evaluation criteria. The results thereof are presented in the following Table 4. In the evaluation described below, the case of Δ or higher is determined to have no problem in practical use and to passing.

—State of Fold Line Portion—

Rank 5: There was peel-off not at all at the fold line portion.

Rank 4: There was peel-off at a part of the folded line portion along the folded line portion.

Rank 3: There was thin line-shaped peel-off along the folded line portion.

Rank 2: There was thick line-shaped peel-off along the folded line portion.

Rank 1: There was large peel-off in an image.

—Evaluation Criteria—

⊙: Fixing lower limit temperature≤100° C., Excellent

○: 100° C.<Fixing lower limit temperature≤125° C., Good

Δ: 125° C.<Fixing lower limit temperature≤150° C., No problem in practical use x: 150° C.<Fixing lower limit temperature, Not suitable for practical use (Separation Property: Hot Offset Resistance)

The surface temperature of a fixing heat roller of a commercially available multi-functional printer "bizhub PRESS C1070" (manufactured by KONICA MINOLTA, INC.) was adjusted to the fixing lower limit temperature+20° C., and an A4 image having a black belt-shaped solid image with a width of 5 cm in the direction perpendicular to the conveyance direction was longitudinally conveyed. At this time, the separation property of the fixing heat roller at the image side and the sheet was determined according to the following evaluation criteria. The results thereof are presented in the following Table 4. In the evaluation described below, the case of Δ or higher is determined to have no problem in practical use and to passing.

—Evaluation Criteria—

⊙: The sheet was separated from the fixing roller, and there was no curl of the sheet.

○: The sheet was separated from the fixing roller, but the sheet was slightly curled.

Δ: The sheet was separated from the fixing roller. However, the trace remained on the image but was not almost recognized.

x: The sheet was separated from the fixing roller, but the trace remained on the image. Alternatively, the sheet was wound on the fixing roller and thus was not separated from the fixing roller.

(Glossiness Evaluation of Fixed Image)

The glossiness was evaluated by using an apparatus that was modified such that the surface temperature of a fixing heat roller could be changed in the range of 100 to 180° C. at an interval of 5° C. in a commercially available multi-functional printer "bizhub PRESS C1070" (manufactured by KONICA MINOLTA, INC.). A sheet having a basis weight of 100 g was used as an image supporting body and a solid image with a toner adhesion amount of 9 g/m$^2$ was output, and glossiness of this fixed image at an incident angel of light of 75 degrees was measured by using "Gardner Micro Gloss 75° Gloss Meter" (manufactured by BYK-Gardner GmbH). Incidentally, the temperature of the fixing heat roller at this time was adjusted so that the surface temperature of the fixing heat roller became the fixing lower limit temperature+20° C. The values of glossiness are presented in the following Table 4. Incidentally, in Table 4, the glossiness at the surface temperature of the fixing heat roller of the fixing lower limit temperature+20° C. was described in the item "Glossiness" (evaluation of the effect of suppressing gloss). In this evaluation, a case where glossiness is in the range of 30 to 60% is determined to passing.

Further, the glossiness was measured in the same manner as described above, except that the surface temperature of the fixing heat roller was changed to the fixing lower limit temperature+40° C. Then, a difference between the glossiness at the fixing lower limit temperature+20° C. and the glossiness at the fixing lower limit temperature+40° C. was calculated. The results thereof are presented in the following Table 4. Incidentally, in Table 4, the difference in the glossiness was described in the item "glossiness difference" (evaluation of fixing temperature dependency of glossiness). In this evaluation, a case where the difference in the glossiness is 30% or less is determined to passing.

TABLE 2

| | | Configuration of binder resin | | | | | | | | |
|---|---|---|---|---|---|---|---|---|---|---|
| | | Amorphous resin | | Crystalline polyester resin | | | | | High-molecular-weight resin | |
| | Toner No. | Type | Solid content (part by mass) | Type | Form | Alcohol monomer | Acid monomer | Solid content (part by mass) | Type | Solid content (part by mass) |
| Example 1 | Toner (1) | (X1) | 400 | (Z1) | HB | 1,4-Butanediol | Sebacic acid | 75 | (Y1) | 25 |
| Example 2 | Toner (2) | (X1) | 400 | (Z2) | HB | 1,4-Butanediol | Dodecanedioic acid | 75 | (Y1) | 25 |

TABLE 2-continued

| | | Configuration of binder resin | | | | | | | | |
|---|---|---|---|---|---|---|---|---|---|---|
| | | Amorphous resin | | Crystalline polyester resin | | | | | High-molecular-weight resin | |
| | Toner No. | Type | Solid content (part by mass) | Type | Form | Alcohol monomer | Acid monomer | Solid content (part by mass) | Type | Solid content (part by mass) |
| Example 3 | Toner (3) | (X1) | 400 | (Z3) | HB | 1,4-Butanediol | Tetradecanedioic acid | 75 | (Y1) | 25 |
| Example 4 | Toner (4) | (X1) | 425 | (Z1) | HB | 1,4-Butanediol | Dodecanedioic acid | 75 | — | 0 |
| Example 5 | Toner (5) | (X1) | 415 | (Z1) | HB | 1,4-Butanediol | Dodecanedioic acid | 75 | (Y1) | 10 |
| Example 6 | Toner (6) | (X1) | 375 | (Z1) | HB | 1,4-Butanediol | Dodecanedioic acid | 75 | (Y1) | 50 |
| Example 7 | Toner (7) | (X1) | 350 | (Z1) | HB | 1,4-Butanediol | Dodecanedioic acid | 75 | (Y1) | 75 |
| Example 8 | Toner (8) | (X1) | 400 | (Z1) | HB | 1,4-Butanediol | Dodecanedioic acid | 75 | (Y2) | 25 |
| Example 9 | Toner (9) | (X1) | 400 | (Z1) | HB | 1,4-Butanediol | Dodecanedioic acid | 75 | (Y3) | 25 |
| Example 10 | Toner (10) | (X1) | 450 | (Z1) | HB | 1,4-Butanediol | Dodecanedioic acid | 25 | (Y1) | 25 |
| Example 11 | Toner (11) | (X1) | 250 | (Z1) | HB | 1,4-Butanediol | Dodecanedioic acid | 225 | (Y1) | 25 |
| Example 12 | Toner (12) | (X1) | 400 | (Z4) | non-HB | 1,4-Butanediol | Dodecanedioic acid | 75 | (Y1) | 25 |
| Comparative Example 1 | Toner (13) | (X1) | 425 | (Z5) | HB | 1,12-Dodecanediol | Dodecanedioic acid | 75 | — | 0 |
| Comparative Example 2 | Toner (14) | (X1) | 425 | (Z6) | HB | 1,6-Hexanediol | Sebacic acid | 75 | — | 0 |
| Comparative Example 3 | Toner (15) | (X2) | 425 | (Z7) | non-HB | 1,4-Butanediol | Succinic acid/fumaric acid | 75 | — | 0 |
| Comparative Example 4 | Toner (16) | (X3) | 425 | (Z8) | non-HB | Ethylene glycol | *1 | 75 | — | 0 |

*1: Sebacic acid/sodium 5-sulfoisophthalic acid/fumaric acid

TABLE 3

| | | THF soluble content of toner | | | Toner thermal property | | Formula (2) | | |
|---|---|---|---|---|---|---|---|---|---|
| | Toner No. | Mw | Mw of resin in F(90-100) | Formula (1) ΔH2/ΔH1 | Tm1 (° C.) | $T_{f1/2}$ (° C.) | 205 − (1.4 × Tm1) | 220 − (1.4 × Tm1) | Condition of Formula (2) |
| Example 1 | Toner (1) | 32,000 | 400,000 | 0.75 | 65 | 115 | 114 | 129 | ○ |
| Example 2 | Toner (2) | 30,000 | 400,000 | 0.80 | 69 | 115 | 108 | 123 | ○ |
| Example 3 | Toner (3) | 31,000 | 400,000 | 0.85 | 74 | 116 | 101 | 116 | ○ |
| Example 4 | Toner (4) | 22,000 | 50,000 | 0.75 | 69 | 109 | 108 | 123 | ○ |
| Example 5 | Toner (5) | 24,000 | 350,000 | 0.78 | 69 | 110 | 108 | 123 | ○ |
| Example 6 | Toner (6) | 40,000 | 420,000 | 0.81 | 69 | 116 | 108 | 123 | ○ |
| Example 7 | Toner (7) | 41,000 | 450,000 | 0.81 | 69 | 117 | 108 | 123 | ○ |
| Example 8 | Toner (8) | 25,000 | 200,000 | 0.81 | 69 | 110 | 108 | 123 | ○ |
| Example 9 | Toner (9) | 62,000 | 1,100,000 | 0.75 | 69 | 120 | 108 | 123 | ○ |
| Example 10 | Toner (10) | 35,000 | 400,000 | 0.68 | 69 | 118 | 108 | 123 | ○ |
| Example 11 | Toner (11) | 28,000 | 400,000 | 0.90 | 69 | 109 | 108 | 123 | ○ |
| Example 12 | Toner (12) | 40,000 | 400,000 | 0.66 | 69 | 114 | 108 | 123 | ○ |
| Comparative Example 1 | Toner (13) | 20,000 | 49,000 | 0.98 | 76 | 115 | 99 | 114 | X |
| Comparative Example 2 | Toner (14) | 22,000 | 51,000 | 0.30 | 59 | 110 | 122 | 137 | X |
| Comparative Example 3 | Toner (15) | 10,000 | 35,000 | 0.55 | 69 | 83 | 108 | 123 | X |
| Comparative Example 4 | Toner (16) | 39,000 | 60,000 | 0.80 | 62 | 118 | 118 | 133 | X |

TABLE 4

| | | Toner evaluation | | | |
|---|---|---|---|---|---|
| | Toner No. | Low temperature fixability | Separation property | Glossiness (° C.) | Temperature dependency of glossiness (glossiness difference, %) |
| Example 1 | Toner (1) | ⊙ | Δ | 40 | 10 |
| Example 2 | Toner (2) | ⊙ | ⊙ | 40 | 10 |
| Example 3 | Toner (3) | ○ | ⊙ | 35 | 10 |

TABLE 4-continued

| | Toner No. | Toner evaluation | | | |
|---|---|---|---|---|---|
| | | Low temperature fixability | Separation property | Glossiness (° C.) | Temperature dependency of glossiness (glossiness difference, %) |
| Example 4 | Toner (4) | ⊙ | Δ | 60 | 25 |
| Example 5 | Toner (5) | ○ | Δ | 50 | 20 |
| Example 6 | Toner (6) | Δ | ○ | 35 | 7 |
| Example 7 | Toner (7) | Δ | ⊙ | 30 | 3 |
| Example 8 | Toner (8) | ⊙ | Δ | 45 | 13 |
| Example 9 | Toner (9) | Δ | ○ | 35 | 8 |
| Example 10 | Toner (10) | Δ | ⊙ | 38 | 12 |
| Example 11 | Toner (11) | ⊙ | Δ | 54 | 24 |
| Example 12 | Toner (12) | Δ | ○ | 40 | 9 |
| Comparative Example 1 | Toner (13) | X | Δ | 45 | 35 |
| Comparative Example 2 | Toner (14) | ○ | X | 50 | 40 |
| Comparative Example 3 | Toner (15) | ⊙ | X | 70 | 31 |
| Comparative Example 4 | Toner (16) | Δ | Δ | 63 | 36 |

From the above results, when the toner particles of Examples were used, the results that low temperature fixability, separation property (hot offset resistance), and the effect of suppressing gloss were excellent with a good balance were obtained. Further, the toners (6) and (7) in which a relatively large amount of the high-molecular-weight resin was added and the toner (9) in which the high-molecular-weight resin having a large weight average molecular weight was added had a relatively large weight average molecular weight of the resin included in the THF soluble content of the toner. Therefore, as described above, the toner particles containing the resin having a relatively large weight average molecular weight in the THF soluble content exhibited the result that temperature dependency of glossiness can be reduced.

On the other hand, the toner according to Comparative Example did not satisfy the relationship represented by the above Formula (1) and/or Formula (2). However, such a toner could not improve the physical properties described above with a good balance.

Although the present invention has been described and illustrated in detail, it is clearly understood that the same is by way of illustrated and example only and is not to be taken byway of limitation, the scope of the present invention being interpreted by terms of the appended claims.

What is claimed is:

1. An electrostatic image developing toner comprising:

a binder resin containing a crystalline polyester resin and an amorphous resin, wherein when, in differential scanning calorimetry of the toner according to ASTM D3418-8, a temperature of an endothermic peak derived from the crystalline polyester resin in a first heating process is defined as Tm1 (° C.), an endothermic quantity based on the endothermic peak in the first heating process is defined as ΔH1 (J/g), an endothermic quantity based on the endothermic peak in a second heating process is defined as ΔH2 (J/q), and a softening temperature is defined as $T_{f1/2}$ (° C.), Tm1 is 60 to 80° C. , $T_{f1/2}$ is 95 to 125° C. , and ΔH1 and ΔH2 satisfy the relationship represented by the following Formulae (1) and (2):

$$0.65 \leq \Delta H2/\Delta H1 \leq 0.95 \quad (1)$$

$$205-(1.4\times Tm1) < T_{f1/2} \leq 220-(1.4\times Tm1) \quad (2).$$

2. The electrostatic image developing toner according to claim 1, wherein a weight average molecular weight of the resin included in a THF soluble content of the toner is 15,000 to 62,000, and when the entire surface integration of an elution curve in GPO obtained by measuring the THF soluble content of the toner is defined as W and an eluted content corresponding to a flow-out content of 90% to 100% of W with time is defined as F(90-100), the weight average molecular weight of the resin included in the eluted content F(90-100) is 200,000 to 1,100,000.

3. The electrostatic image developing toner according to claim 2, wherein the weight average molecular weight of the resin included in the eluted content F(90-100) is 50,000 to 1,100,000.

4. The electrostatic image developing toner according to claim 2, wherein the ΔH2/ΔH1 satisfies the following Formula (3):

$$0.75 \leq \Delta H2/\Delta H1 \leq 0.83 \quad (3).$$

5. The electrostatic image developing toner according to claim 2, wherein the Tm1 is 65 to 75° C.

6. The electrostatic image developing toner according to claim 2, wherein a value of the $T_{f1/2}$ is 110 to 120° C.

7. The electrostatic image developing toner according to claim 2, wherein the weight average molecular weight of the resin included in the THF soluble content of the toner is 30,000 to 50,000.

8. The electrostatic image developing toner according to claim 2, wherein a content of the crystalline polyester resin is 10 to 30% by mass.

9. The electrostatic image developing toner according to claim 2, wherein the hybrid crystalline polyester resin is a graft copolymer having a comb-shaped structure including an amorphous resin unit as a stem and a crystalline polyester resin unit as a branch.

10. The electrostatic image developing toner according to claim 2, wherein a content of the crystalline polyester resin unit of the hybrid crystalline polyester resin is more than 65% by mass but equal to or less than 95% by mass with respect to the total amount (considered to 100% by mass) of the hybrid resin.

11. The electrostatic image developing toner according to claim 2, wherein the amorphous resin unit other than a polyester resin of the hybrid crystalline polyester resin is a vinyl resin unit.

12. The electrostatic image developing toner according to claim 1, wherein the amorphous resin contained in the binder resin is a vinyl resin.

13. The electrostatic image developing toner according to claim 1, wherein the crystalline polyester resin is a hybrid crystalline polyester resin obtained by chemically binding a crystalline polyester resin unit and an amorphous resin unit other than a polyester resin.

14. The electrostatic image developing toner according to claim 1, wherein a content of the crystalline polyester resin is 5 to 45% by mass with respect to the total amount of the binder resin.

15. A method for producing the electrostatic image developing toner according to claim 1, the method comprising:

dispersing the crystalline polyester resin and the amorphous resin in a water-based medium to prepare a dispersion liquid; and aggregating and fusing the crystalline polyester resin and the amorphous resin in the dispersion liquid.

* * * * *